US009353544B2

(12) United States Patent
Takahashi et al.

(10) Patent No.: US 9,353,544 B2
(45) Date of Patent: May 31, 2016

(54) COLUMN BASE FITTING AND COLUMN BASE STRUCTURE USING IT

(71) Applicant: Hitachi Metals Techno, Ltd., Tokyo (JP)

(72) Inventors: Hideaki Takahashi, Tokyo (JP); Michio Itoh, Tokyo (JP); Hidenori Tanaka, Tokyo (JP); Hisatomo Mochiduki, Tokyo (JP); Kumiko Masuda, Tokyo (JP)

(73) Assignee: SENQCIA CO., LTD. (JP)

( * ) Notice: Subject to any disclaimer, the term of this patent is extended or adjusted under 35 U.S.C. 154(b) by 0 days.

(21) Appl. No.: 14/346,990

(22) PCT Filed: Oct. 24, 2013

(86) PCT No.: PCT/JP2013/078790
§ 371 (c)(1),
(2) Date: Mar. 25, 2014

(87) PCT Pub. No.: WO2014/069317
PCT Pub. Date: May 8, 2014

(65) Prior Publication Data

US 2015/0082719 A1 Mar. 26, 2015

(30) Foreign Application Priority Data

Oct. 30, 2012 (JP) ..... 2012-239659
Aug. 29, 2013 (JP) ..... 2013-178558

(51) Int. Cl.

| | |
|---|---|
| ***E02D 27/00*** | (2006.01) |
| ***E04H 12/22*** | (2006.01) |
| ***E04B 1/24*** | (2006.01) |
| ***E04B 1/58*** | (2006.01) |
| ***E04B 1/41*** | (2006.01) |
| ***E04C 2/08*** | (2006.01) |
| ***E04B 2/00*** | (2006.01) |

(52) U.S. Cl.
CPC ..... *E04H 12/2261* (2013.01); *E04B 1/24* (2013.01); *E04B 1/2403* (2013.01); *E04B 1/40* (2013.01); *E04B 1/58* (2013.01); *E04C 2/08* (2013.01); *E04C 2/44* (2013.01); *E04B 1/4157* (2013.01); *E04B 2001/2463* (2013.01)

(58) Field of Classification Search
CPC ..... E04H 12/2261; E04B 1/24; E04B 1/58; E04B 1/2403; E04B 1/40; E04B 2001/2463; E04B 1/4157; E04C 2/44; E04C 2/08
USPC ..... 52/295–297
See application file for complete search history.

(56) References Cited

U.S. PATENT DOCUMENTS 4,793,111 A * 12/1988 Shewchuk ..... 52/298
5,501,048 A * 3/1996 Nakanishi ..... 52/296

(Continued)

FOREIGN PATENT DOCUMENTS

JP H08184061 A 7/1996
JP 20008495 A 1/2000

(Continued)

*Primary Examiner* — Adriana Figueroa
(74) *Attorney, Agent, or Firm* — Bacon & Thomas, PLLC

(57) ABSTRACT

A column base fitting 42 includes a bottom plate 42*c* having an approximately square plate shape and a support base 42*f* inside from the peripheral part of an upper surface 42*d* of the bottom plate 42*c*. A first bolt insertion holes 42*a* is formed in each four corner portions of the bottom plate 42*c* and a second bolt insertion hole 42*b* is formed at two positions closer to the center part than the first bolt insertion hole 42*a*, in the length direction of each four sides of the bottom plate 42*c*. A corner built-up portion 42*r* is formed at both ends in the length direction of the side surface 42*h* of the support base 42*f*, having a shape protruding outward in the perpendicular direction from the side surface 42*h* and filling the corner portion between the side surface 42*h* and an upper surface of the bottom plate 42*c*.

50 Claims, 26 Drawing Sheets

(56) References Cited

U.S. PATENT DOCUMENTS

| | | | | | |
|---|---|---|---|---|---|
| 5,678,382 | A | * | 10/1997 | Naito | 52/745.21 |
| 5,819,487 | A | * | 10/1998 | Bull et al. | 52/296 |
| 8,898,991 | B2 | * | 12/2014 | Cai et al. | 52/651.01 |

FOREIGN PATENT DOCUMENTS

| | | | |
|---|---|---|---|
| JP | 2003336266 | A | 11/2003 |
| JP | 200561088 | A | 3/2005 |
| JP | 2005344289 | A | 12/2005 |

* cited by examiner

*FIG. 20* - Prior Art
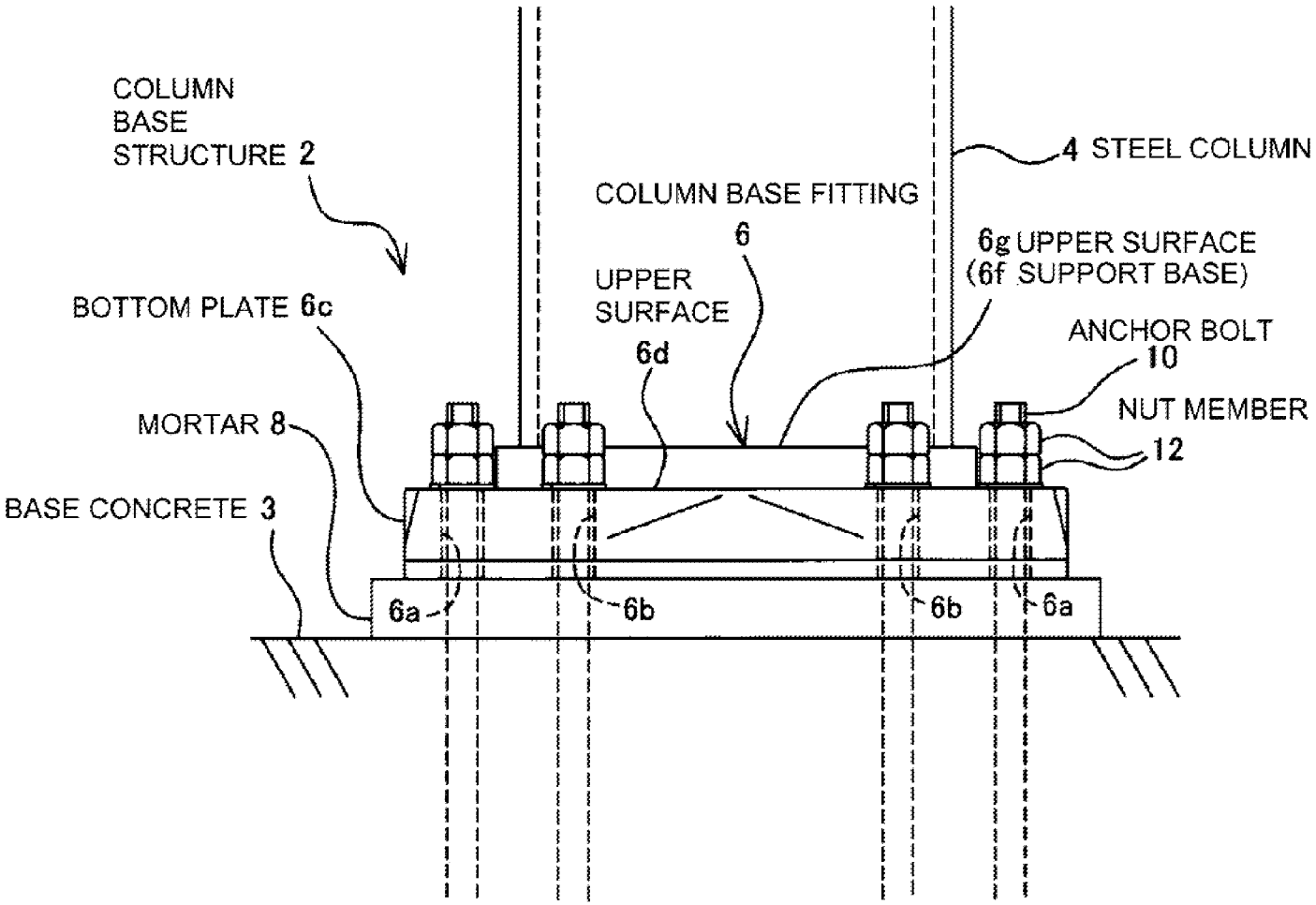

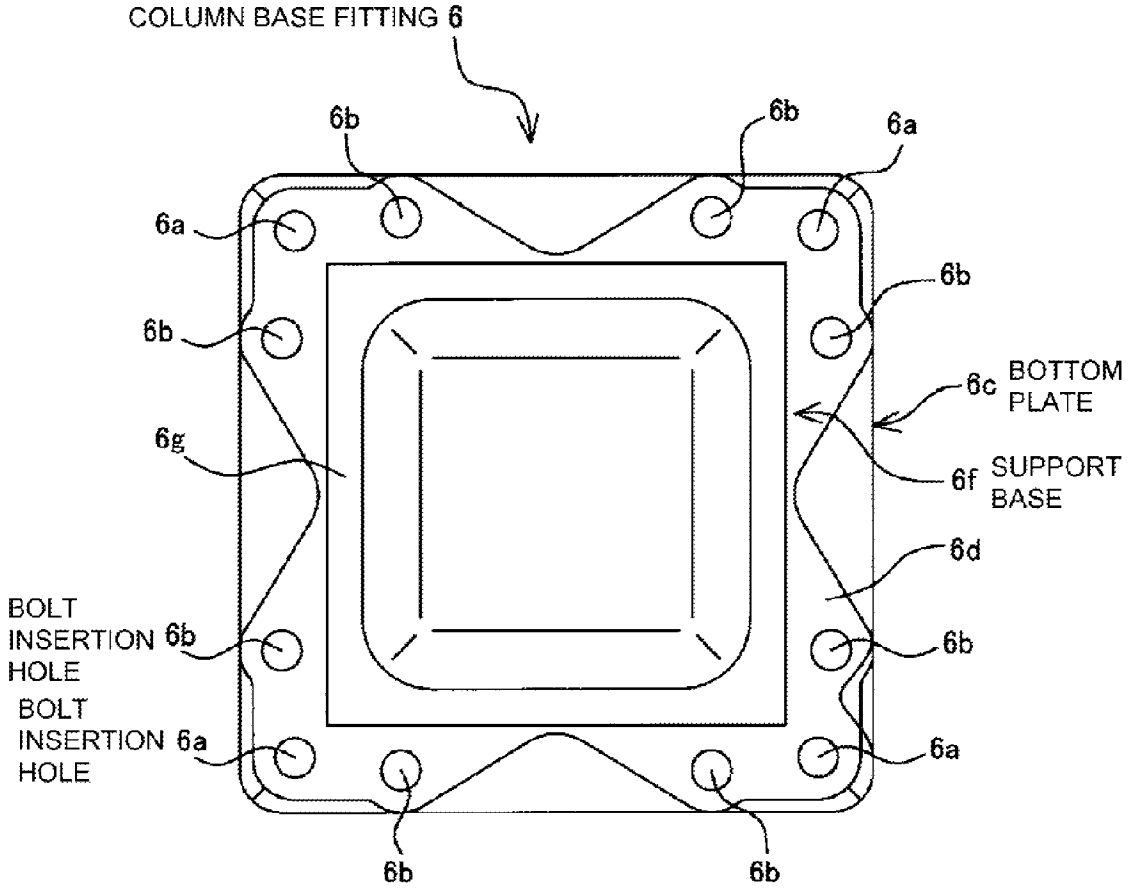
*FIG. 21* - Prior Art

*FIG. 22* - Prior Art
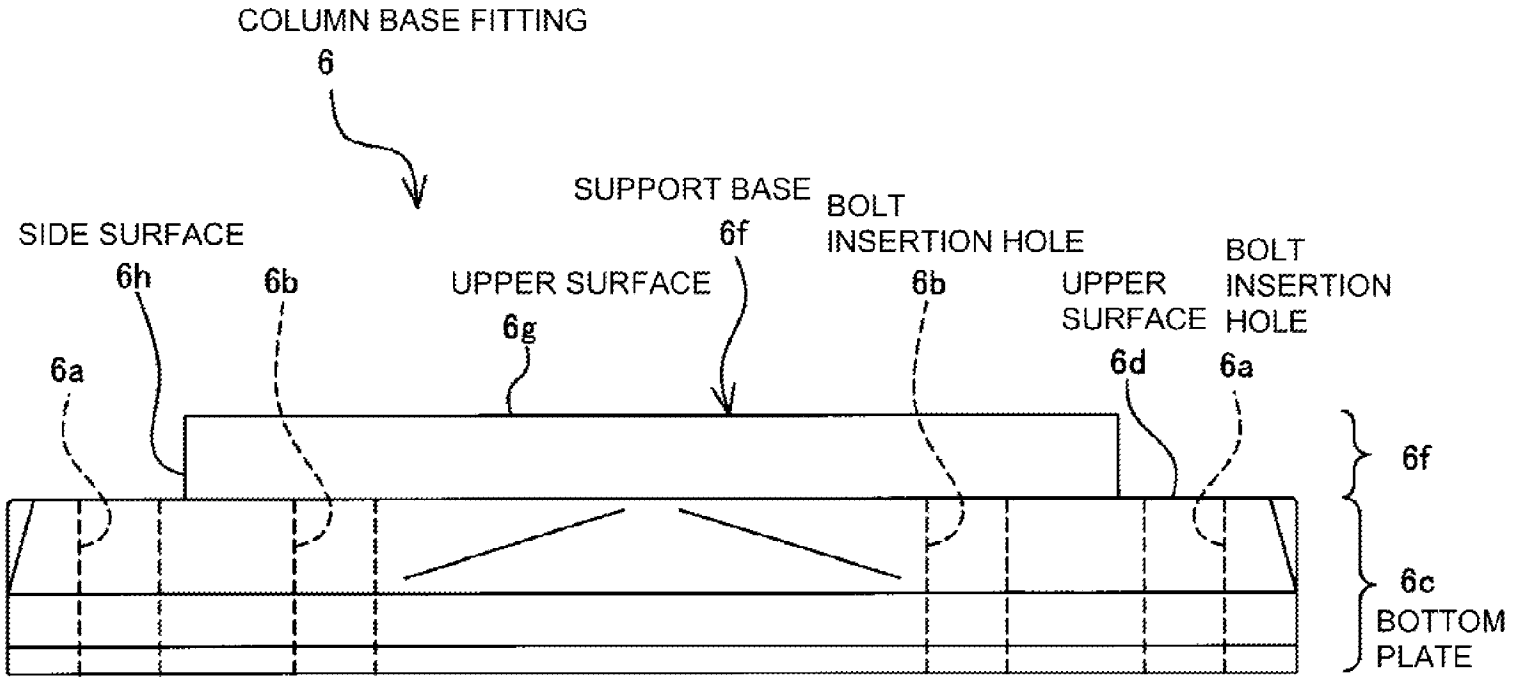

*FIG. 23* - Prior Art
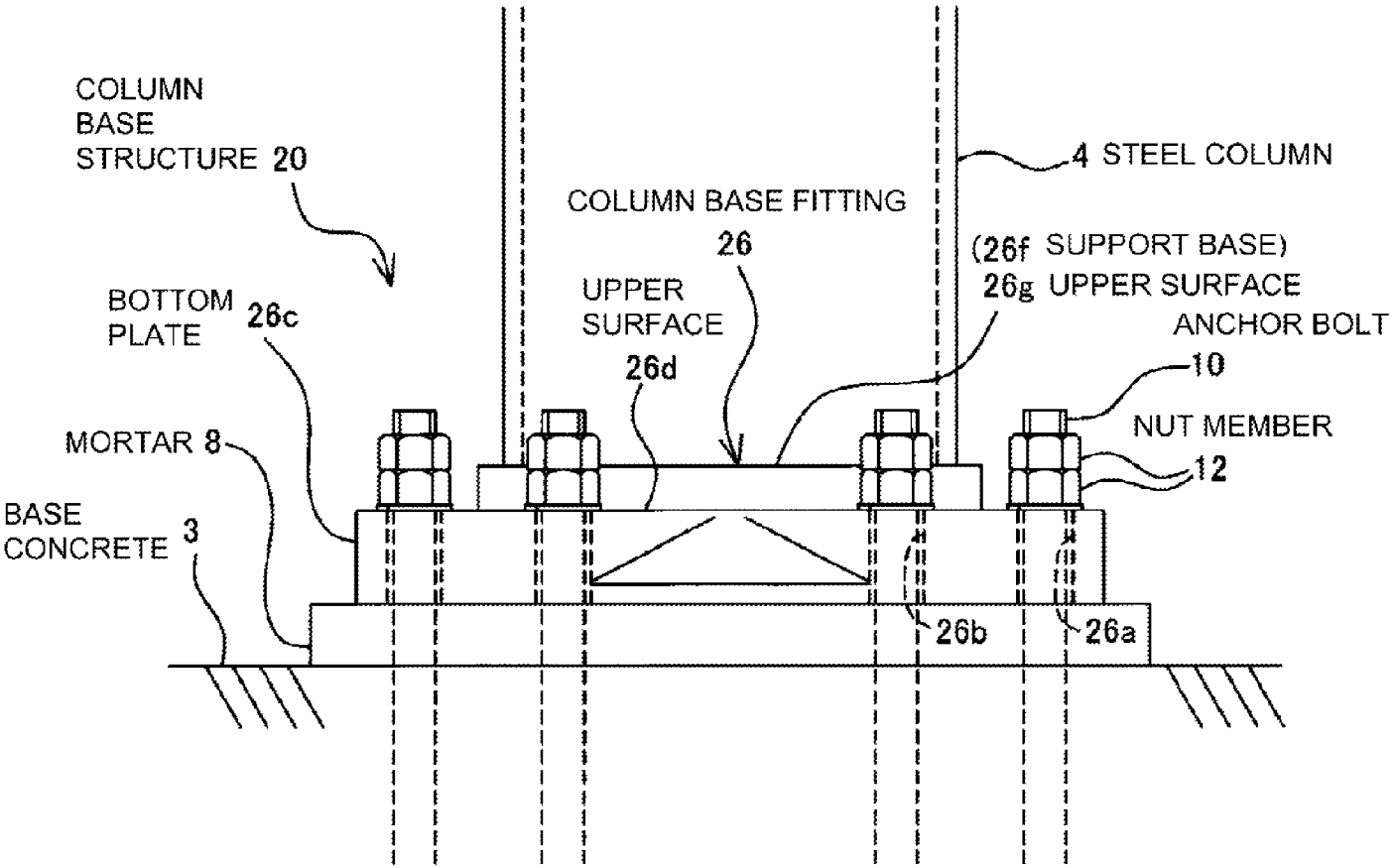

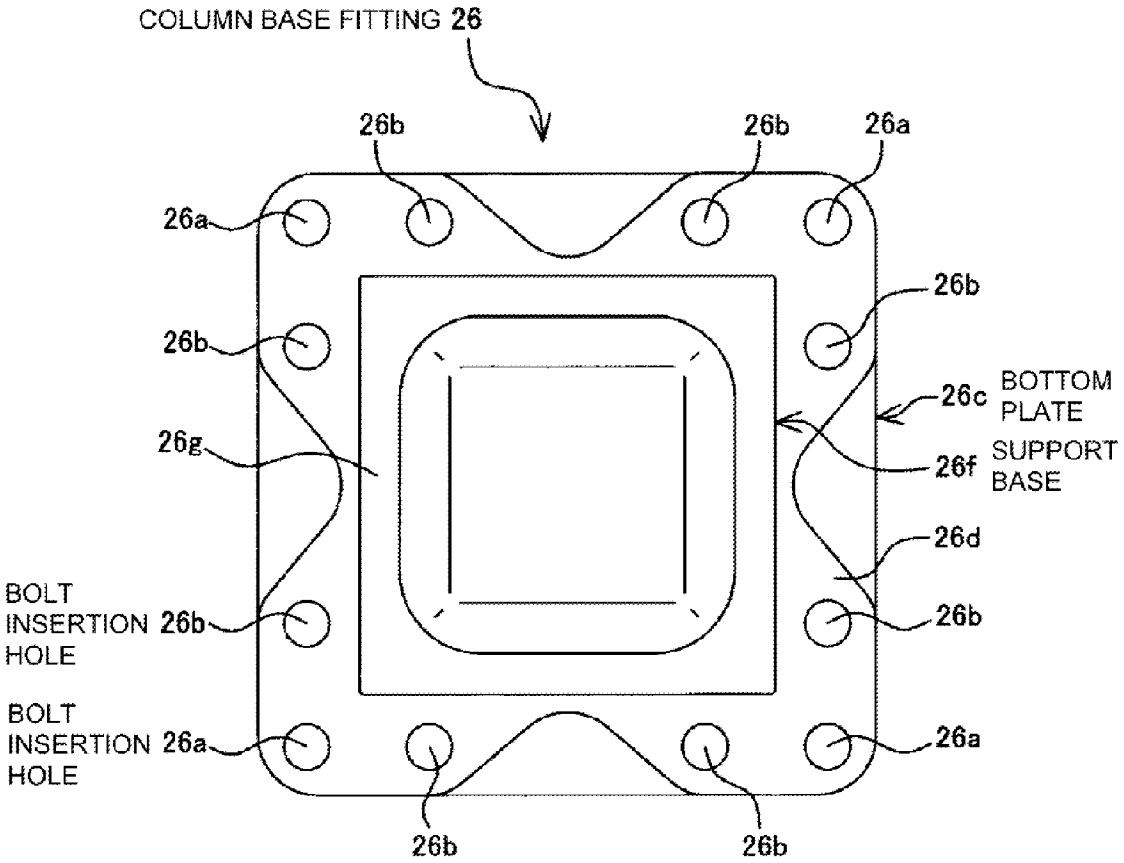
*FIG. 24* - Prior Art

*FIG. 25* - Prior Art
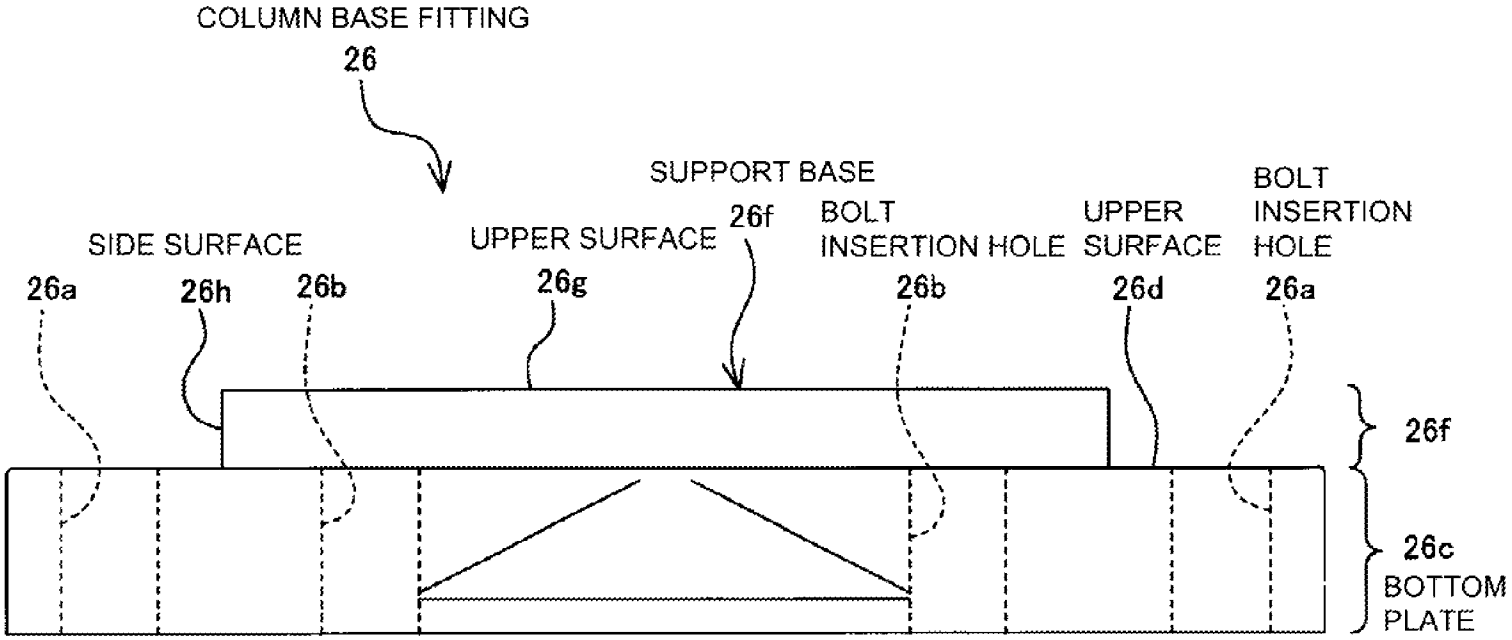

*FIG. 26* - Prior Art
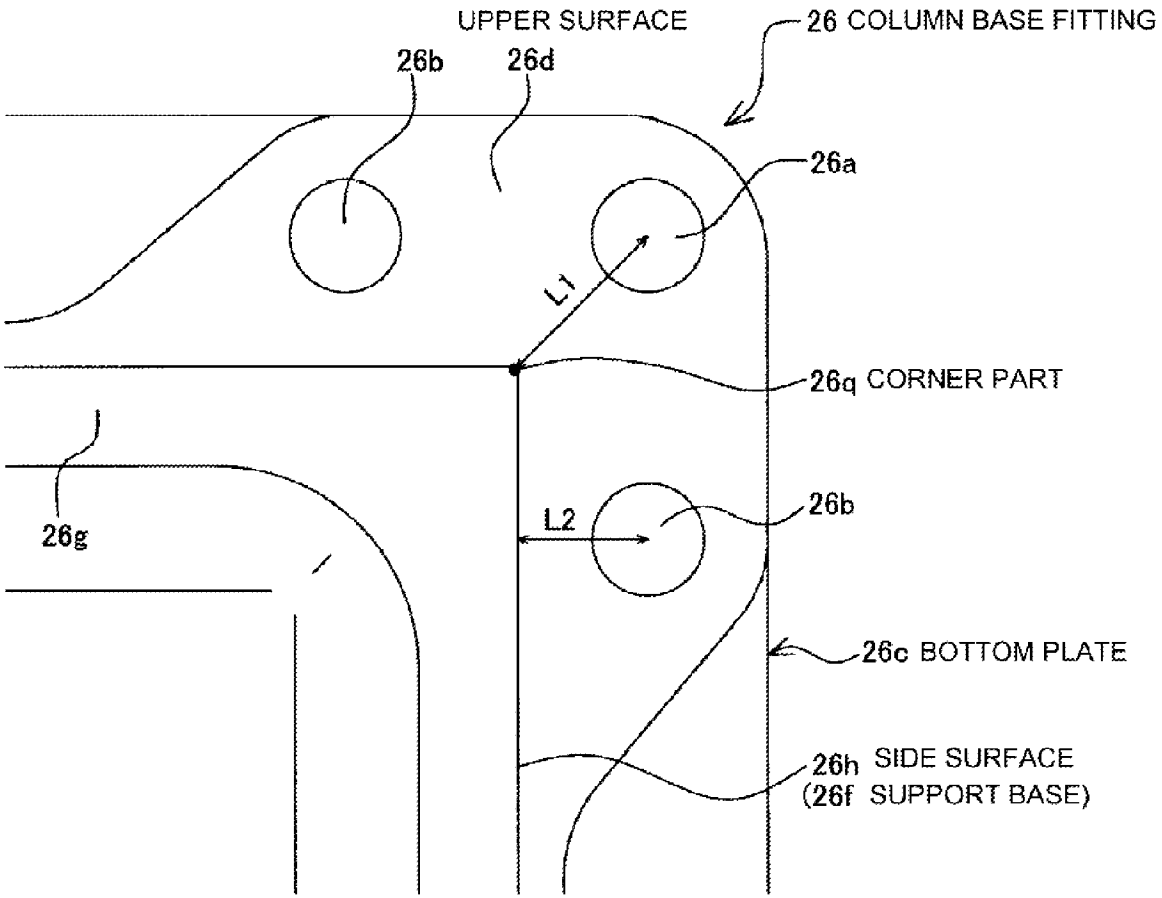

COLUMN BASE FITTING AND COLUMN BASE STRUCTURE USING IT

BACKGROUND OF THE INVENTION

1. Field of the Invention

The present invention relates to a column base fitting joining a lower end of a column member of a construction structure on the column base fitting and screwed with a top end of an anchor bolt protruding upward from inside a base concrete, and a column base structure using it.

2. Description of the Conventional Art

FIGS. 20 to 22 are reference views explanting a conventional column base fitting 6 and a conventional column base structure 2 using it.

As illustrated in FIG. 20, the conventional column base structure 2 includes a column base fitting 6 including a bottom plate 6*c* and a support base 6*f*. The support base 6*f* is inside a periphery part of the upper surface 6*d* of the bottom plate 6*c* and highly protruding upward. A lower end surface of a steel column 4 (column member) is jointed on an upper surface of the support base 6*f* of the column base fitting 6 by welding. The column base fitting 6 is provided on a base concrete 3 through a mortar 8.

An top end of an anchor bolt 10 penetrating the mortar 8 and protruding upward from inside the base concrete 3, is inserted in bolt insertion holes 6*a* and 6*b* in the column base fitting 6 (refer to FIG. 21), and female screws of two nut members 12 (double nuts, refer to FIG. 20), which are stacked up and down, are screwed with a male screw formed on the anchor bolt 10. In such a way, the steel column 4 is stood and fixed on the base concrete 3 through the column base fitting 6 (for example, refer to Japanese Patent Application Laid-Open No. 2003-336266).

The column base fitting 6 in the conventional column base structure 2 is made of a metal and formed to be an approximately plate shape having a square plane and thickness. Further, in the column base fitting 6, bolt insertion holes 6*a* and 6*b* penetrating in the thickness direction of the bottom plate 6*c* (the perpendicular direction to the drawing paper in the figure) are formed in total 12. The outer diameter of these holes is approximately the same and one anchor bolt is loosely inserted in each hole.

One bolt insertion hole 6*a* in the column base fitting 6 is formed in each four corner portions of the square shape of the bottom plate 6*c* respectively.

Further, the center position of the bolt insertion hole 6*b* is located at a position closer to the center of a side in length than the bolt insertion hole 6*a* in the corner portion, in both ends of the four sides of the square shape.

FIGS. 23 to 26 are reference views explaining a conventional column base fitting 26 and a conventional column base structure 20 using it.

As illustrated in FIG. 23, the conventional column base structure 20 is different from the conventional column base structure 2 concerning having the column base fitting 20 instead of the column base fitting 6. The other constitutions are the same as the conventional column base structure 2.

Namely, in the column base structure 2, the center position of the bolt insertion hole 6*a* is located at a position slightly shifted closer to the center of the support base 6*f* from the cross point of two lines. One line passes two center positions of the bolt insertion holes 6*b* formed at two positions in the length direction of one side in the bottom plate 6*c*. Another line passes two center positions of the bolt insertion holes 6*b* formed at two positions in the length direction of adjacent side in the perpendicular direction to the one side.

On the other hand, in the column base structure 20, the center position of the bolt insertion hole 26*a* is located at the cross point position.

For transmitting the force generated in the steel column 4 by an earthquake, etc., to the base concrete 3 through the bottom plates 6*c* and 26*c*, and the anchor bolt 10, the thicknesses of the bottom plates 6*c* and 26*c* are designed to withstand a predetermined bending stress. At this time, the thicknesses of the bottom plate 6*c* and 26*c* are determined as a value proportional to the tensile strength of each anchor bolt 10 and a distance from the center of the anchor bolt 10 to the lower end position in height of the side surface of the support base 6*f* and 26*f*.

SUMMARY OF THE INVENTION

Problems to be Solved by the Invention

However, as illustrated in FIGS. 21 and 24, the forms of the upper surfaces 6*g* and 26*g* of the support bases 6*f* and 26*f* correspond to the cross-sectional shape of the lower end of the steel column 4. Further, the upper surfaces 6*g* and 26*g* of the support base 6*f* and 26*f* are the same shape in the boundary horizontal cross-sectional surface with the bottom plates 6*c* and 26*c*, which are the lower ends in height of the side surface of the support bases 6*f* and 26*f* as illustrated in FIGS. 22 and 25. Thus, the side surfaces 6*h* and 26*h* from the upper surfaces 6*g* and 26*g* to the lower ends in height of the support base 6*f* and 26*f* are perpendicular to the upper surfaces 6*d* and 26*d* of the bottom plates 6*c* and 26*c*.

Therefore, when the horizontal distance from the center position of the bolt insertion holes 6*a*, 6*b*, 26*a*, and 26*b* to the lower end position in height of the side surface of the support base 6*f* and 26*f* increases, the rigidity of the column base fitting 6 and 26 is necessary to increase by increasing the thicknesses of the bottom plates 6*c* and 26*c*, to withstand the bending moment transmitted from the steel column 4. As the result, since the thicknesses of the bottom plates 6*c* and 26*c* increases, there has been a problem of the increase of size, weight, and cost.

Further, in the column base structure 20, as illustrated in FIG. 26, a length L1 is larger than a length L2. The length L1 is from the center position of the bolt insertion hole 26*a* to the lower end position in height of a corner part 26*q* of support base 26*f*, which is the shortest position from the bolt insertion hole 26*a*. The length L2 is from the center position of the bolt insertion hole 26*b* to the lower end position in height of the side surface 26*h* of the support base 26*f*, which is the shortest position from the center position of the bolt insertion hole 26*b*.

The bending moment acting to the bottom plate 26*c* by the tensile force in the anchor bolt 10 illustrated in FIG. 23, is proportional to the length of the shortest distance from the each center position of the bolt insertion holes 26*a* and 26*b* to the lower end position in height of the side surface 26*h* of the support base 26*f*.

Therefore, the bending moment in the corner portion of the square shape of the bottom plate 26*c*, in which the bolt insertion hole 26*a* is formed, is larger than the bending moment at a part which is close to the center part of side in the length of the bottom plate 26*c*. The bolt insertion hole 26*a* is formed in the corner portion of the square shape of the bottom plate 26*c*. The bolt insertion hole 26*b* is formed at a part close to the center part of the side. Thus, the bending deformation in the corner portion becomes large.

Further, the bending moment by the tensile force applied to the anchor bolt 10 inserted in the bolt insertion hole 26*a* becomes larger than the bending moment by the tensile force applied to the anchor bolt 10 inserted in the bolt insertion hole 26*b*. As the result, the possibility that only corner portions of the square shape of the bottom plate 26*c* yield increases.

Thus, for increasing the flexural capacity to withstand the tensile force in the anchor bolt 10 in the corner portion of the square shape of the bottom plate 26*c*, it is necessary to increase the thickness of the bottom plate 26*c* to increase the rigidity of the bottom plate 26*c*. The bolt insertion hole 26*a* is formed in the corner portion of the square shape. However, it has been a problem that the increase of size, weight, and cost of the column base fitting 26 generates by increasing the thickness of the bottom plate 26*c*.

In view of the above problems, the present invention is directed to provide a column base fitting which can prevent the increase of size, weight, and cost thereof and a column base structure using it.

Means to Solve the Problems

For solving the above problems, a column base fitting according to the present invention includes a bottom plate formed to be an approximately plate shape having a square shape, both surfaces of upper and lower, and thickness, and a support base inside from a peripheral part of an upper surface of the bottom plate and having a height upward, wherein a lower end of a column member is jointed on a upper surface of the support base.

In the column base fitting, a first bolt insertion hole is formed at a position in each four corner portions of the square shape, and a second bolt insertion hole is formed at two positions closer to the center part than the first bolt insertion hole in the length direction in each four sides of the square shape, and a first corner built-up portion is formed to have a shape protruding outward in the perpendicular direction from the side surface, in both ends in the length direction of a side surface of the support base, wherein the first corner built-up portion fills the corner portion between the side surface and an upper surface of the bottom plate.

Further, in the column base fitting according to the present invention, a length from a center position of the first bolt insertion hole to a lower end position of the corner part of the support base and a length of the shortest distance from the center position of the second insertion hole to the lower end of the first corner built-up portion are approximately same.

Further, in the column base fitting according to the present invention, a second corner built-up portion is formed to have a shape protruding outward in the perpendicular direction from the side surface, at two positions closer to the center part than the first corner built-up portion in the length direction of the side surface of the support base.

The second corner built-up portion fills the corner portion between the side surface and the upper surface of the bottom plate.

Further, in the column base fitting according to the present invention, a length from the center position of the first bolt insertion hole to the lower end position of the corner part of the support base and a length of the shortest distance from the center position of the second insertion hole to the lower end of the second corner built-up portion are approximately same.

Further, in the column base fitting according to the present invention, a length of the shortest distance from the center position of the second bolt insertion hole to the lower end position of the first corner built-up portion, a length of the shortest distance from the center position of the second bolt insertion hole to the lower end position of the second corner built-up portion, and a length from the center position of the second bolt insertion hole to the lower end of the side surface, which is the shortest distance, are approximately same.

Further, for solving the above problems, a column base structure includes a column base fitting including;

a bottom plate formed to be an approximately plate shape having a square shape, both surfaces of upper and lower, and thickness, the support base on the center side of a peripheral part of the upper surface of the bottom plate and having a height upward, wherein the lower end of the steel column member is jointed on the upper surface of the support base.

In the column base fitting, a first bolt insertion hole is formed at each position in four corner portions of the square shape, a second bolt insertion hole is formed at two positions closer to the center part than the first bolt insertion hole in the length direction in each four sides of the square shape, and a first corner built-up portion is formed to have a shape protruding outward in the perpendicular direction from the side surface, in both ends in the length direction of a side surface of the support base, wherein the first corner built-up portion fills the corner portion between the side surface and an upper surface of the bottom plate.

Further, in the column base structure according to the present invention, a second corner built-up portion is formed at two positions closer to the center part than the first corner built-up portion in the length direction of the side of the support base, wherein the second built-up portion fills the corner portion between the side surface and the upper surface of the bottom plate and wherein the second corner built-up portion protrudes outward in the perpendicular direction from the side surface.

Further, for solving the above problems, a column base fitting includes, a bottom plate formed to be an approximately plate shape having a square shape, both surfaces of upper and lower, and thickness, a support base on the center side of an outer contour of the upper surface of the bottom plate and has a height upward, wherein the lower end of the steel column member is jointed on the upper surface of the support base.

In the column base fitting, a third bolt insertion hole respectively is formed at position in each four corner portions of the square shape, a fourth bolt insertion hole is formed at two positions closer to the center than the third bolt insertion hole in the length direction in each side of the outer contour, a third corner built-up portion is formed so as to have a position approaching the centers of the third bolt insertion hole and the fourth bolt insertion hole, in a part being the shortest distance from the center position of the third insertion hole of the support base, wherein the third corner built-up portion fills the corner portion between a side surface of the support base and an upper surface of the bottom plate.

Further, in the column base fitting according to the present invention, the third corner built-up portion includes a first protrusion portion and a second protrusion portion.

The first protrusion portion inclines upward from a predetermined height position at a part being the shortest distance from the center position of the third bolt insertion hole in the support base to the upper surface of the bottom plate and protrudes toward the center position of the third bolt insertion hole.

In two positions in the corner portion between two parts on the fourth bolt insertion side of the first protrusion portion and the side surface of the support base, the second protrusion portion inclines toward the upper surface of the bottom plate from the predetermined height position of the support base and approaches the center position of the fourth bolt insertion hole Further, in the column base fitting according to the present invention, in the third corner built-up portion, the length of the shortest distance from the center position of the third bolt insertion hole to the third corner built-up portion and the length of the shortest distance from the center position of the fourth bolt insertion hole to the side surface of the support base are approximately same.

Further, in the column base fitting according to the present invention, in the third corner built-up portion, the length of the shortest distance from the center position of the third bolt insertion hole to the side surface of the support base, and the length of the shortest distance from the center position of the fourth bolt insertion hole to the third corner built-up portion are approximately same.

Further, in the column base fitting according to the present invention, the center position of the third bolt insertion hole is located at a cross point position by two lines. One line passes two center positions of the fourth bolt insertion holes formed at two positions in the length direction of one side of the bottom plate. Another line passes two center positions of the fourth bolt insertion holes formed at two positions in the length direction of another side adjacent in the perpendicular direction to the one side.

Further, in the column base fitting according to the present invention, the center position of the third bolt insertion hole is located at a position shifted to closer to the center part of the support base than a cross point position by two lines. One line passes two center positions of the fourth bolt insertion holes formed at two positions in the length direction of one side of the bottom plate. Another line passes two center positions of the fourth bolt insertion holes formed at two positions in the length direction of another side adjacent in the perpendicular direction to the one side.

For solving the above problems, the column base structure according to the present invention includes a column base fitting including;

a bottom plate formed to be an approximately plate shape having a square shape, both surfaces of upper and lower, and thickness, and a support base on the center side of an outer contour of an upper surface of the bottom plate and has a height upward, wherein a lower end of a column member is jointed on a upper surface of the support base.

In the column base fitting, the third bolt insertion hole is formed in each position of the corner portion of the outer contour, the fourth insertion hole is formed at two position closer to the center part than the third insertion hole in the length direction of each side of the outer contour, and the third corner built-up portion is formed so as to have a position approaching the centers of the third bolt insertion hole and the fourth insertion hole, in the part in the shortest distance from the center position of the third insertion hole in the support base, wherein the third corner built-up portion fills the corner portion between the side surface of the support base and the upper surface of the bottom plate, is formed.

Effect of the Invention

According to such a column base fitting of the present invention, the column base fitting includes a bottom plate formed approximately a plate shape having a square shape, both surfaces of upper and lower, and thickness, and a support base inside from a peripheral part of the upper surface of the bottom plate and has a height upward, wherein a lower end of a column member is jointed on the upper surface of the support base.

In the column base fitting, a first bolt insertion hole is formed at a position in each four corner portions of the square shape, and a second bolt insertion hole is formed at two positions closer to the center part than the first bolt insertion hole in the length direction in each four sides of the square shape, wherein a first corner built-up portion is formed to have a shape protruding outward in the perpendicular direction from the side surface, in both ends in the length direction of a side surface of the support base, wherein the first corner built-up portion fills the corner portion between the side surface and the upper surface of the bottom plate and Taking such a constitution, a column base fitting capable of preventing the increase of size, weight, and cost can be provided.

Further, a column base structure according to the present invention includes, a column base fitting having a bottom plate formed approximately a plate shape having a square shape, both surfaces of upper and lower, and thickness, and a support base inside from a peripheral part of the upper surface of the bottom plate and having a height upward, wherein a lower end of a column member is jointed on a top surface of the support base.

In the column base fitting, a first bolt insertion hole is formed at each position in four corner portions of the square shape, and a second bolt insertion hole is formed at two positions closer to the center part than the first bolt insertion hole in the length direction in each four sides of the square shape, wherein a first corner built-up portion is formed to have a shape protruding outward in the perpendicular direction from the side surface, in both ends in the length direction of a side surface of the support base, wherein the first corner built-up portion fills the corner portion between the side surface and an upper surface of the bottom plate, and Taking such a constitution, a column base structure capable of preventing the increase of size, weight, and cost can be provided.

Further, the column base fitting according to the present invention includes a bottom plate formed to be an approximately plate shape having a square shape, both surfaces of upper and lower, and thickness, a support base on the center side from an outer contour of the upper surface of the bottom plate and having a height upward, wherein the lower end of the steel column member is jointed on the upper surface of the support base.

In the column base fitting, a third bolt insertion hole respectively is formed at each position in four corner portions of the square shape, and a fourth bolt insertion hole is formed at two positions closer to the center part than the third bolt insertion hole in the length direction in each four sides of the square shape, and the third corner built-up portion is formed so as to have a position approaching the centers of the third bolt insertion hole and the fourth insertion hole, in the part in the shortest distance from the center position of the third insertion hole in the support base, wherein the third corner built-up portion fills the corner portion between a side surface of the support base and an upper surface of the bottom plate.

Taking such a constitution, the flexural capacity of the entirety of column base fitting containing the corner portion can be increased, and the column base fitting capable of preventing the increase of size, weight, and cost and the column base structure using it can be provided.

Further, a column base structure according to the present invention includes, a column base fitting having a bottom plate formed approximately a plate shape having a square shape, both surfaces of upper and lower, and thickness, and a support base at the center side from an outer contour of the upper surface of the bottom plate and having a height upward, in which a lower end of a column member is jointed on a top surface of the support base.

In the column base fitting, a third bolt insertion hole is formed at each position in four corner portions of the square shape, and a fourth bolt insertion hole is formed at two positions closer to the center part than the third bolt insertion hole in the length direction in each four sides of the square shape, and the third corner built-up portion is formed so as to have a position approaching the centers of the third bolt insertion hole and the fourth insertion hole, in the part in the shortest distance from the center position of the third insertion hole in the support base, wherein the third corner built-up portion fills the corner portion between a side surface of the support base and the upper surface of the bottom plate.

Taking such a structure, the flexural capacity of the entire column base structure including the corner portion can increase, and the increase of size, weight, and cost can be prevented.

BRIEF EXPLANATION OF DRAWINGS

FIG. 20 is conceptual side view illustrating the conventional column base structure 2.

FIG. 21 is a top view of a column base fitting 6 in the column base structure 2 illustrated in FIG. 20.

FIG. 22 is a side view of the column base fitting 6 illustrated in FIG. 20.

FIG. 23 is a side view illustrating a conventional column base structure 20.

FIG. 24 a top view of the column base fitting 26 in the column base structure 20 illustrated in FIG. 23.

FIG. 25 is a side view of the column base fitting 26 illustrated in FIG. 24.

FIG. 26 is a partially enlarged top view illustrating the right upper part of the column base fitting 26 illustrated in FIG. 24.

EXPLANATION OF REFERENCE NUMERALS

Figure 1:
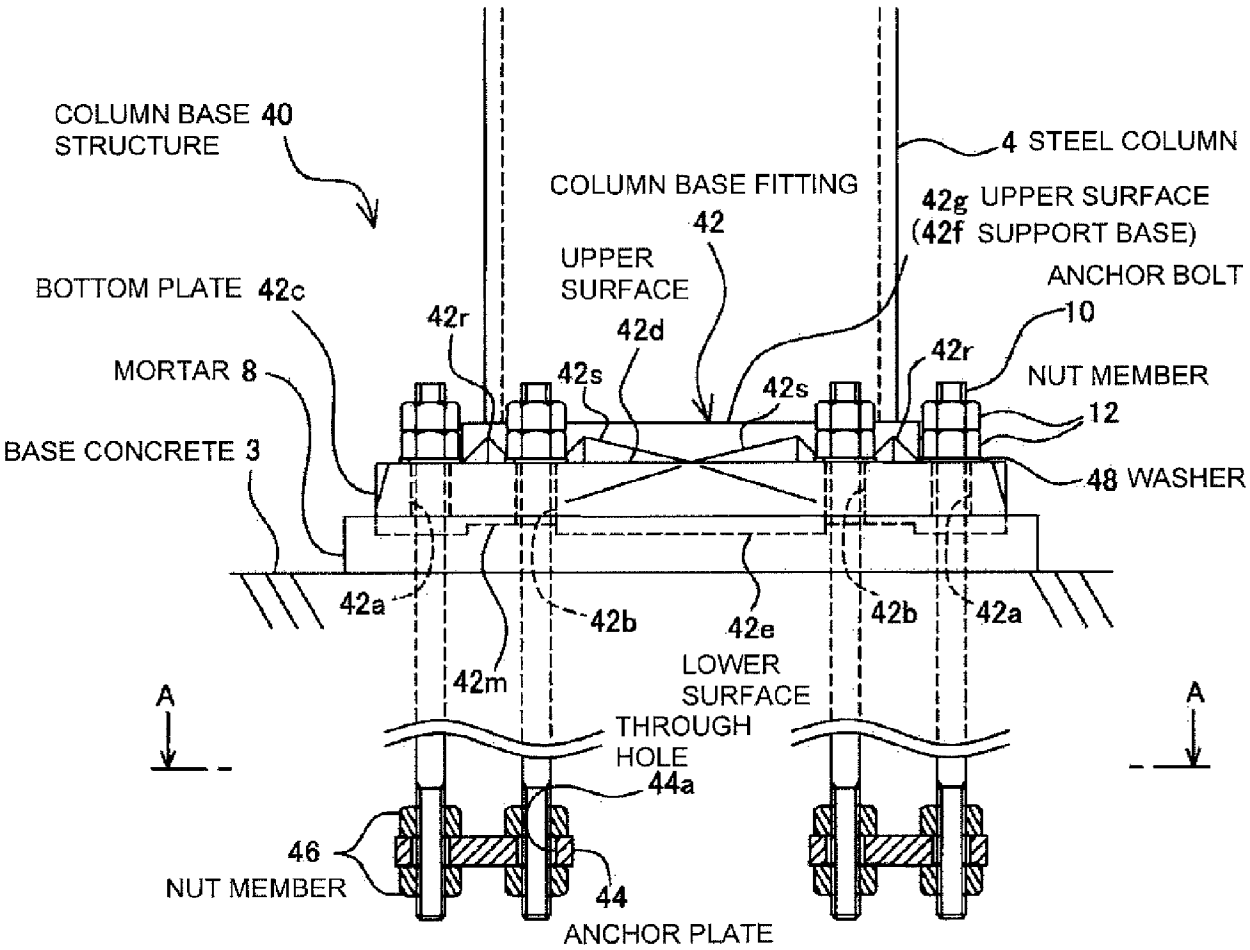
FIG. 1 is a partial cross-sectional side view illustrating a column base structure 40 according to the first exemplary embodiment of the present invention.

2, 20: column base structure
3: base concrete
4: steel column
6, 26: column base fitting
6*a*, 6*b*, 26*a*, 26*b*: bolt insertion hole
6*c*, 26*c*: bottom plate
6*d*, 26*d*: upper surface
6*f*, 26*f*: support base
6*g*, 26*g*: upper surface
8: mortar

10: anchor bolt
12: nut member
14: main reinforcing steel
40, 50, 60: column base structure
42, 52, 62: column base fitting
42*a*, 42*b*, 52*a*, 52*b*, 62*a*, 62*b*: bolt insertion hole
42*c*, 52*c*, 62*c*: bottom plate
42*d*, 52*d*, 62*d*: upper surface
42*e*, 52*e*, 62*e*: lower surface
42*f*, 52*f*, 62*f*: support base
42*g*, 52*g*, 62*g*: upper surface
42*h*, 52*h*, 62*h*: side surface
42*i*, 52*i*, 62*i*: recess portion
42*j*, 52*j*, 62*j*: inclination recess portion
42*k*, 62*k*: corner external inclination surface
42*m*, 52*m*, 62*m*: step recess portion
42*n*, 52*n*, 62*n*: boundary step surface
42*o*: recess plane
42*p*, 62*p*: corner external surface
42*q*, 52*q*, 62*q*: corner part
42*r*, 42*s*, 54, 64: corner built-up portion
42*t*, 42*u*: ridge side portion
42*v*: ridge line
42*w*, 42*x*: ridge side portion
42*y*: ridge line
44: anchor plate
44*a*: through hole
46: nut member
48: washer
54*a*, 54*b*: half built-up portion
54*c*: built-up end portion
54*t*, 54*u*, 54*v*: ridge side portion
F, F1: horizontal force
H, I, J, K: apex
L1, L2, L3, L4, L5: length
L6, L7, L8, L9: length
Q, R, S, U: apex
V, W, X, Y, L, M: apex

DETAILED DESCRIPTION OF PREFERRED EMBODIMENT

The exemplary embodiments of the column base fitting according to the present invention and the column base structure using it will be described in detail based on drawings as follows.

FIG. 1 to FIG. 8 are the reference views explaining a column base fitting 42 according to the first exemplary embodiment and a column base structure 40 using it.

As illustrated in FIG. 1, the column base structure 40 includes the column base fitting 42 (refer to FIG. 2) and the column base fitting 42 is provided upward on a base concrete 3 through a mortar 8.

Figure 3:
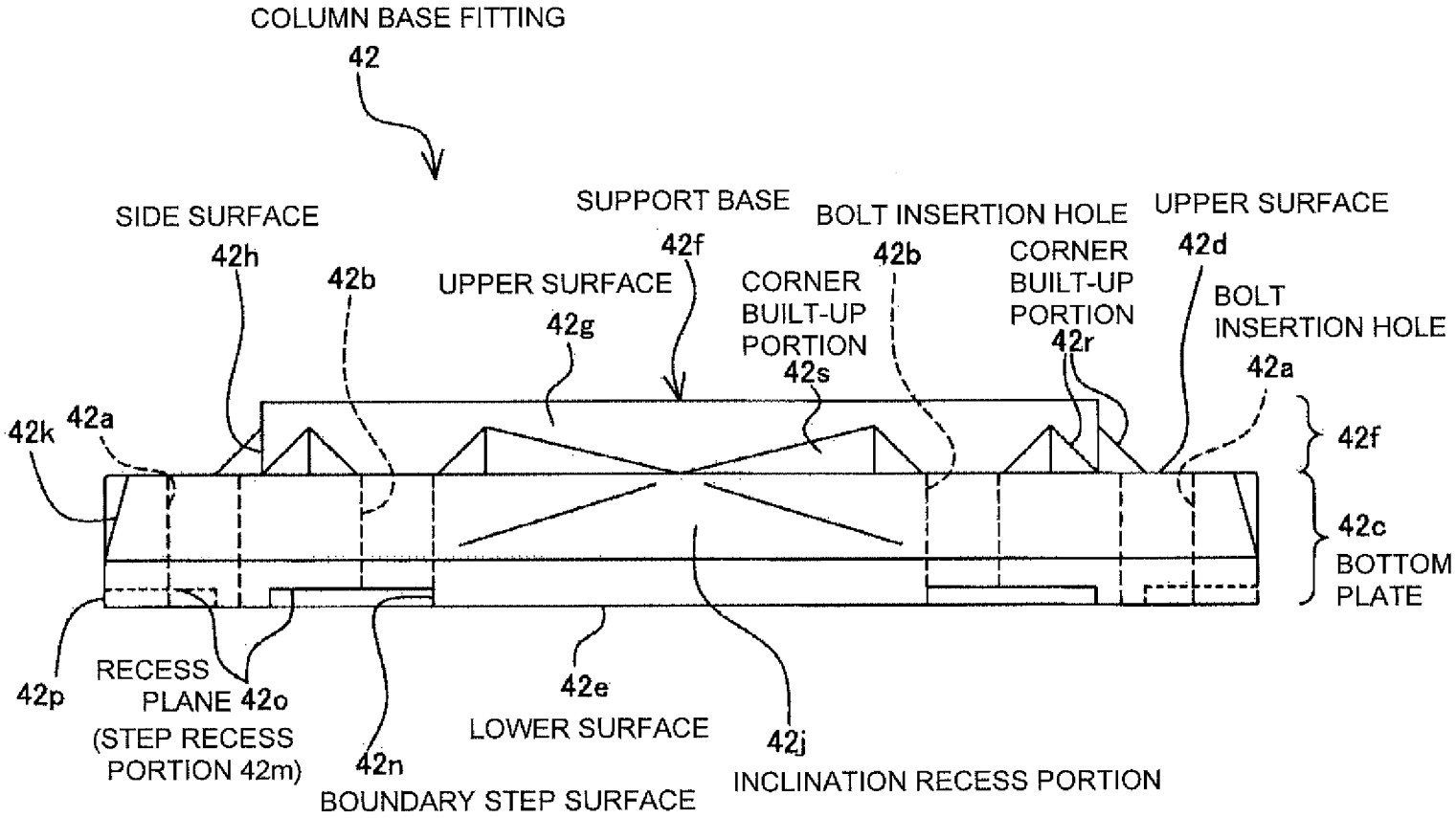
FIG. 3 is a side view of the column base fitting 42 illustrated in FIG. 2.

Further, as illustrated in FIG. 3, the column base fitting 42 includes a bottom plate 42*c* and a support base 42*f*. A lower end surface of a steel column 4 (column member, refer to FIG. 1) formed to be a rectangular tube having a length in the vertical direction is jointed on an upper surface 42*g* of the support base 42*f* by welding.

Figure 2:
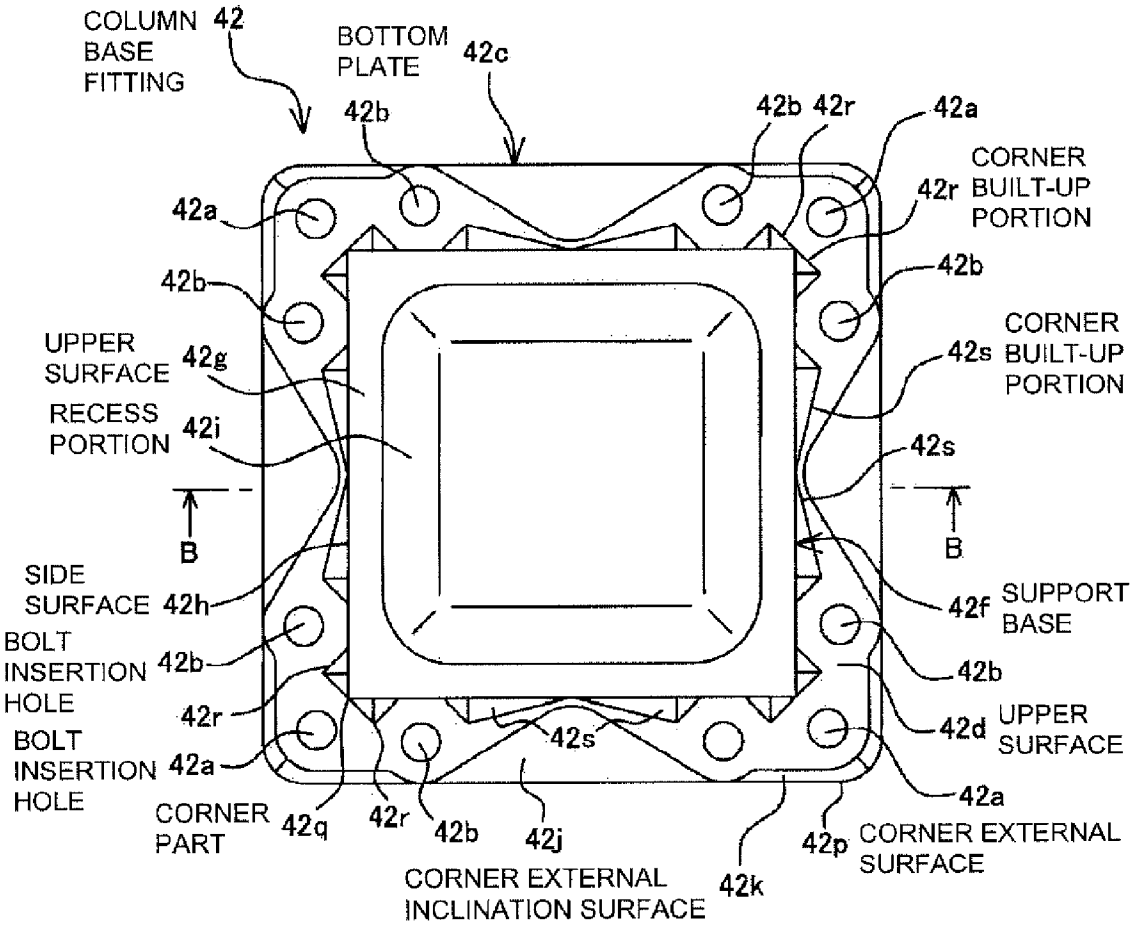
FIG. 2 is a top view of a column base fitting 42 in the column base structure 40 illustrated in FIG. 1.

Top ends of anchor bolts 10 penetrating the mortar 8 from inside the base concrete 3 and protruding upward are inserted in a bolt insertion holes 42*a* and 42*b* formed in the bottom plate 42*c* of the column base fitting 42 as illustrated in FIG. 2 and FIG. 3.

As illustrated in FIG. 1, a male screw part formed on the top end of the anchor bolt 10, which protrudes upward from the upper surface 42*d* of the bottom plate 42*c* of the column base fitting 42, is inserted in a center hole of a washer 48, screwed with a female part, in which two nut members 12 (double nuts) are stacked up and down, and thereby the steel column 4 is stood and fixed on the base concrete 3 through the column base fitting 42 and the mortar 8.

The column base fitting 42 is made of a metal and includes a plane having a square shape illustrated in FIG. 2, the bottom plate 42*c* having a height and formed to be an approximately plate shape illustrated in FIG. 3, and the support base 42*f*. The support base 42*f* is inside (center side) from a periphery part of the upper surface 42*d* of the bottom plate 42*c* and has a height upward as illustrated in FIG. 3. The bottom plate 42*c* and the support base 42*f* are integrally formed by casting together with corner built-up portions 42*r* and 42*s* described later.

Figure 4:
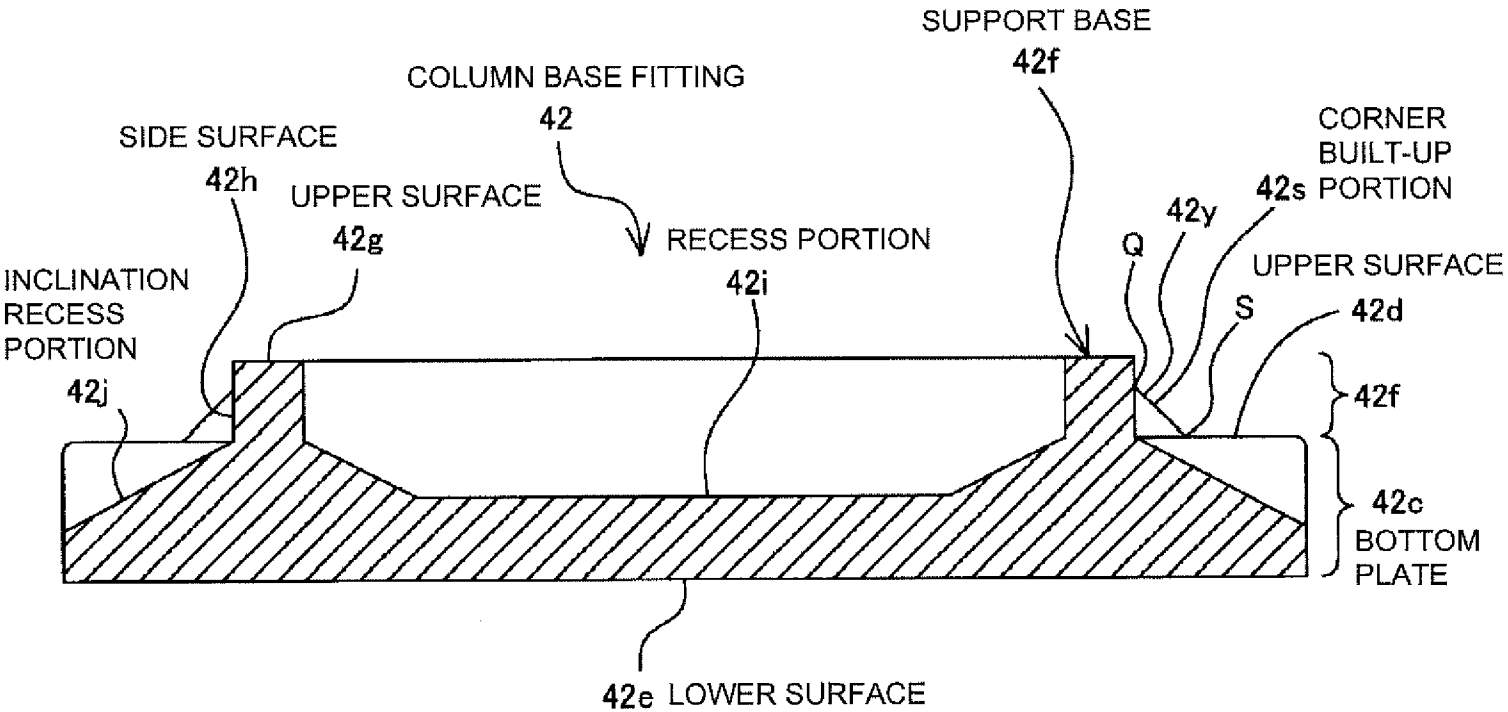
FIG. 4 is a cross-sectional view taken along a line B-B in the column base fitting 42 illustrated in FIG. 2.

As illustrated in FIG. 2, an external form of the support base 42*f* of the column base fitting 42 is formed to be a slightly larger square shape than a square shape of the lower end surface of the steel column 4. The upper surface 42*g* of the support base 42*f* is formed to be an annular rectangular shape having a width in the perpendicular direction to each side thereof. As illustrated in FIG. 4, a recess portion 42*i* recessing downward in the figure is formed on an inner side (center side) than the width of the annular rectangular shape of the upper surface 42*g*.

The upper surface 42*g* of the support base 42*f* is smoothly formed and the lower end surface of the steel column 4 is placed and jointed thereon.

In the bottom plate 42*c* of the column base fitting 42, in four corner portions thereof illustrated in FIG. 2, a corner external inclination surface 42*k* is formed inclining toward the position close to the center part of the upper surface 42*d* of the bottom plate 42*c* from a corner external surface 42*p*. The corner external inclination surface 42*k* is positioned on an upper side in the height direction in FIG. 3. The corner external surface 42*p* is positioned at a lower side in height direction in the figure. The height from the lower end of the corner external inclination surface 42*k* to the lower end of the corner external surface 42*p* on the lower side is formed to be lower than the entire height from the upper surface 42*d* to the lower surface 42*e* of the bottom plate 42*c*.

Further, in the center part in the each length direction of the four sides of the bottom plate 42*c*, as illustrated in FIG. 4, an inclination recess portion 42*j* is formed to be a triangle shape as illustrated in FIGS. 2 and 3. In the inclination recess portion 42*j*, the height of the bottom plate 42*c* is gradually reduced toward the outside of the of the bottom plate 42*c* from the height on the center side of the upper surface 42*d* of the bottom plate 42, as approaching the side surface of the side of the bottom plate 42*c*.

Namely, as illustrated in FIGS. 2 and 3, the inclination recess portion 42*j* is formed in an approximately triangle area surrounded by lines connecting three positions. In the four sides each of the bottom plate 42*c*, two positions correspond to the positions each of the two bolt insertion holes 42*b* and 42*b* and on the lower end side in height of the bottom plate 42*c*. One position is close to the boundary of the center part in length of the side surface 42*h* of the support base 42*f* and the upper surface 42*d* of the bottom plate 42*c*.

As illustrated in FIG. 2, in the bottom plate 42*c*, the bolt insertion hole 42*a* (first bolt insertion hole) and the bolt insertion hole 42*b* (second bolt insertion hole) are formed by three in the four corner portions each in total 12, the bolt insertion holes 42*a* and 42*b* passing therethrough in the height direction of the bottom plate 42*c* (perpendicular direction with respect to the drawing paper in the figure). Each diameter of these bolt insertion holes 42*a* and 42*b* is approximately same and one anchor bolt 10 is inserted in each bolt insertion hole.

The bolt insertion hole 42*a* is formed one by one in close to the four corner portions each of the square shape of the bottom plate 42*c*.

Further, two center positions of the bolt insertion holes 42*b* are located at the position closer to the length center of the side than the bolt insertion hole 42*a* in the corner portion, in both ends of each four sides of the square shape of the bottom plate 42*c*.

Figure 5:
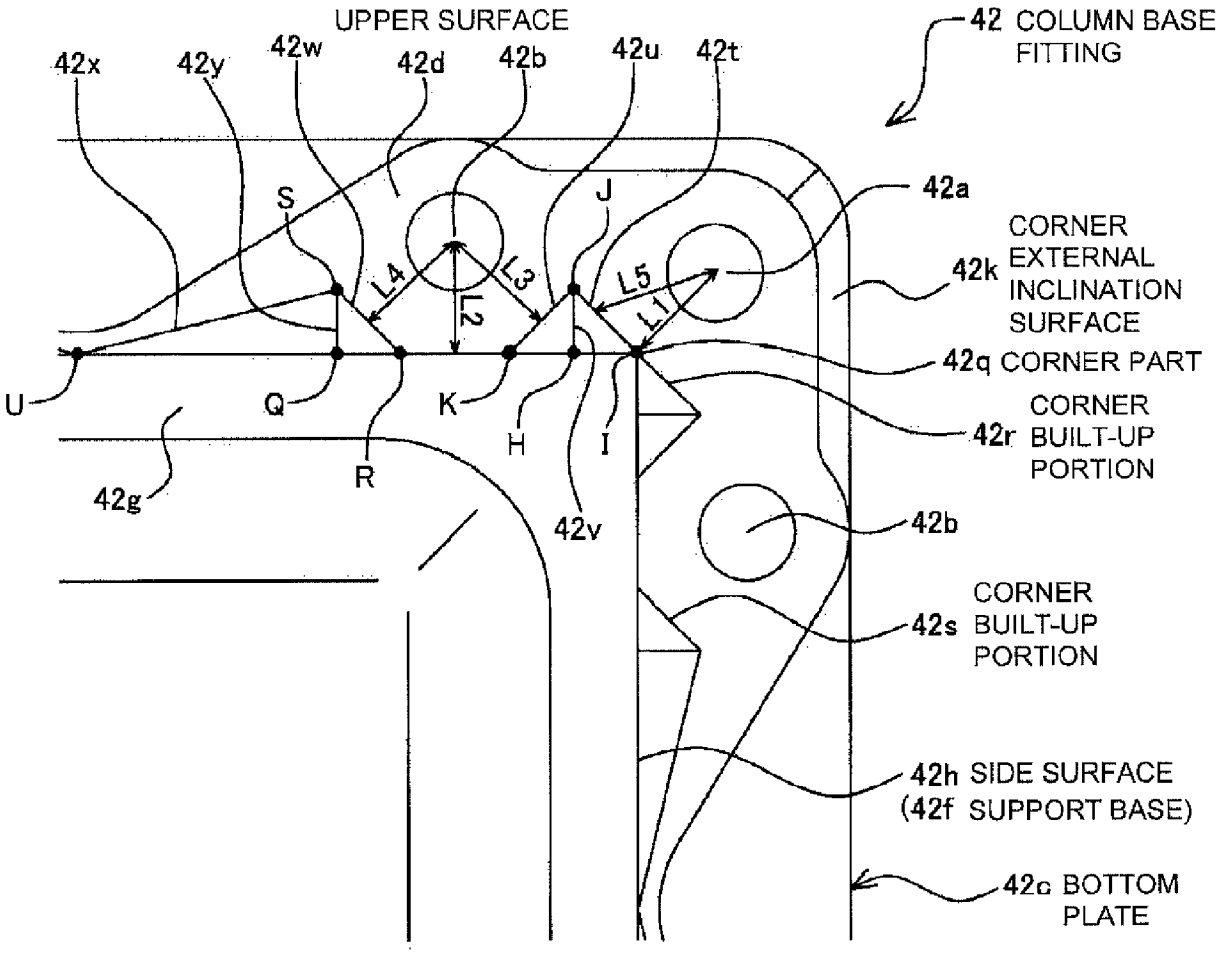
FIG. 5 is a view enlarging the upper right part of the column base fitting 42 illustrated in FIG. 2, that is, a partially enlarged top view for explaining the corner built-up portions 42*r* and 42*s*.

Further, as illustrated in FIG. 5, the bolt insertion holes 42*a* and 42*b* are located at the position in which a length L1 is approximately same as a length L2. The length L1 from the center position of the bolt insertion hole 42*a* to the lower end position (an apex I described later) in height of the corner part 42*q* of the support base 42*f*. The size length L2 is from the center position of the bolt insertion hole 42*b* to the lower end position in height of the side surface 42*h* of the support base 42*f*, which is the shortest distance from the center position of the bolt insertion hole 42*b*.

As illustrated in FIGS. 2 and 5, a corner built-up portion 42*r* (first corner built-up portion) and a corner built-up portion 42*s* (second corner built-up portion) are integrally formed between each side surface 42*h* of four sides of the support base 42*f* of the column base fitting 42 and the upper surface 42*d* of the bottom plate 42*c*. These corner built-up portions 42*r* and 42*s* have a boundary vertical cross-section between the side surface 42*h* of the support base 42*f* and a boundary horizontal cross-section between the upper surface 42*d* of the bottom plate 42*c*.

Namely, as illustrated in FIG. 2, in both two ends in the length direction of the side surface 42*h* of the support base 42*f*, the corner built-up portion 42*r* having an approximately triangular pyramid shape, which fills the corner portion between the side surface 42*h* and upper surface 42*d* of the bottom plate 42*c* and protrudes toward the approximately perpendicular direction outside from the side surface 42*h*.

The corner built-up portion 42*r* is formed to be an approximately triangular pyramid having four apexes H, I, J, and K, as illustrate in FIG. 5. The corner built-up portion 42*r* has a ridge side portion 42*t* connecting the apex I and the apex J. The apex I is a corner point at lower edge position in height of the corner part 42*q* of the support base 42*f*. The apex J is on the upper surface 42*d* of the bottom plate 42*c* and protrudes outside in the approximately perpendicular direction from the side surface 42*h* of the support base 42*f*. Further, the corner built-up portion 42*r* has a ridge side portion 42*u* connecting the apex K and the apex J. The apex K is at the lower end position in height of the side surface 42*h*, and in the opposite side of the apex I with respect to an apex H described later.

Two triangles sandwiched with each the ridge side portion 42*t* and the ridge side portion 42*u* of the corner built-up portion 42*r*, and a ridge line 42*v* described later, are formed to be a symmetrical shape each other with respect to the ridge line 42*v* connecting the apex H and the apex J. The apex H is positioned on the upper side from the center part in height direction of the side surface 42*h* of the support base 42*f*.

Further, the ridge line 42*v* of the corner built-up portion 42*r* is formed at an angle of approximately 45 degrees with respect to the upper surface 42*d* of the bottom plate 42*c* and the side surface 42*h* of the support base 42*f*.

Further, in the ridge side portion 42*u* of the built-up portion 42*r*, the length L3 of the shortest distance from the center position of the bolt insertion hole 42*b* is set to be an approximately same length as the length L1 from the center position of the bolt insertion hole 42*a* to the position of the apex I.

Further, as illustrated in FIG. 2, at the position of two places closer to the center in the length direction than the built-up portion 42*r* in the length direction of the side surface 42*h* of the support base 42*f*, a corner built-up portion 42*s* having an approximately triangular pyramid shape is formed. The corner built-up portion 42*s* fills the corner portion between the side surface 42*h* and the upper surface 42*d* of the bottom plate 42*c* and protrudes outside in the approximately perpendicular direction from the side surface 42*h*.

The corner built-up portion 42*s* is formed to be an asymmetrical triangular pyramid having four apexes Q, R, S, and U as illustrated in FIG. 5. The corner built-up portion 42*s* has a ridge side portion 42*x* and a ridge side portion 42*w*. The ridge side portion 42*x* connects the apex U and the apex S. The apex U is at the lower end position in height of the center part in the length direction of the side surface 42*h* of the support base 42*f*. The apex S protrudes from the side surface 42*h* to the outside and is on the upper surface 42*d* of the bottom plate 42*c*. The ridge side portion 42*w* connects the apex R and the apex S. The apex R is in the opposite side of the apex U with respect to the apex Q described later and at the lower end position in height of the side surface 42*h*.

Two triangles sandwiched with each the ridge side portion 42*w* and the ridge side portion 42*x* of the corner built-up portion 42*s* and a ridge line 42*y* described later, are formed on both sides of the ridge line 42*y* connecting the apex Q and the apex S. The apex Q is positioned on the upper side from the center part in height of the side surface 42*h* of the support base 42*f* (refer to FIG. 4). The ridge side portion 42*x* is longer than the ridge side portion 42*w*, and thus two triangles are formed to be an asymmetrical shape with respect to the ridge line 42*y*.

Further, the ridge line 42*y* of the corner built-up portion 42*s* is formed at an angle of approximately 45 degrees with respect to the upper surface 42*d* of the bottom plate 42*c* and the side surface 42*h* of the support base 42*f*.

Further, in the ridge side portion 42*w* of the corner built-up portion 42*s*, the length L4, which is the shortest distance from the center position of the bolt insertion hole 42*b*, is set to be an approximately same as the length L1 from the center position of the bolt insertion hole 42*a* to the apex I.

In FIG. 5, by forming the corner built-up portions 42*r* and 42*s* in the column base fitting 42, the lengths L3 and L4 becomes to be shorter than lengths in the same direction as the lengths L3 and L4 when the corner built-up portion 42*r* and 42*s* are not formed. The lengths L3 and L4 are from the center position of the bolt insertion hole 42*b* to the lower end position in height of the corner built-up portions 42*r* and 42*s*, which are the shortest distance. The lengths in the same direction as the L3 and L4 are from the center position of bolt insertion hole 42*b* to the lower end position in height of the side surface 42*h* of the support base 42*f*.

Further, in FIG. 5, by forming the corner-built up portions 42*r* in the column base fitting 42, the length L5 becomes to be shorter than a length in the same direction as the length L5 when the corner built-up portion 42*r* is not formed. The length L5 is from the center position of the bolt insertion hole 42*a* to the ridge side portion 42*t*. The length in the same direction as the length L5 is from the center position of the bolt insertion hole 42*a* to the lower end position in height of the side surface 42*h* of the support base 42*f*.

As described above, for withstanding the bending moment transmitted from the steel column 4, the thickness of the bottom plate 42*c* needs to be set in proportion to the length from the center positions of the bolt insertion holes 42*a* and 42*b* to the lower end position in height of the support base 42*f*.

Therefore, by forming the built-up portions 42*r* and 42*s*, the length from the center positions of the bolt insertion holes

42*a* and 42*b* to the lower end position in height of the support base 42*f* in the ridge side portions 42*t*, 42*u* and 42*w* is shortened, so that the thickness of the bottom plate 42*c* can be thinned.

In this way, in the column base structure 40 according to the present exemplary embodiment, since the corner built-up portion 42*r* and the corner built-up portion 42*s* are formed in the column base fitting 42, the rigidity in the lower end position in height of the side surface 42*h* of the support base 42*f* can be increased only the required size at the required position.

Namely, effectively reinforcing the weak part in rigidity in the column base fitting 42 by the corner built-up portions 42*r* and 42*s*, the rigidity of the column base fitting 42 can be increased. Thus, the thickness of the bottom plate 42*c* can be thinner than the thickness of the bottom plate of the column base fitting in which the built-up portion 42*r* and the built-up portion 42*s* are not formed.

Further, in the column base fitting 42, the lengths L3 and L4 are set to be approximately same as the lengths L1 and L2. The lengths L3 and L4 are the shortest distance from the center position of the bolt insertion hole 42*b*, in the ridge side portion 42*u* of the corner built-up portion 42*r* and ridge side portion 42*w* of the corner built-up portion 42*s*. The length L1 is from the center position of the bolt insertion hole 42*a* to the position of the apex I. The length L2 is the shortest distance from the center position of the bolt insertion hole 42*b* to the lower end position in height of the side surface 42*h* of the support base 42*f*.

In this way, by forming the corner built-up portions 42*r* and 42*s* to the column base fitting 42, the lengths are equalized from the center positions of all the bolt insertion holes 42*a* and 42*b* formed at 12 positions of the bottom plate 42*c* to the lower end positions in height of the side surface 42*h* of the support base 42*f* or the each corner built-up portion.

Therefore, the stress acting on the bottom plate 42*c* by the bending moment transmitted from the steel column 4 is proportional to the length from the center positions of the bolt insertion holes 42*a* and 42*b* to the lower end position of the side surface 42*h* of the support base 42*f* or each corner built-up portion. Thus, by equalizing the lengths, it can be prevented that high stress locally act on a part of the bottom plate 42*c*.

Therefore, in the column base structure 40 according to the present embodiment, since the corner built-up portions 42*r* and 42*s* are formed in the column base fitting 42, the flexural capacity of the entire column base structure 40 can increase, and the increase of size, weight, and cost of the column base fitting 42 can be prevented.

Figure 6:
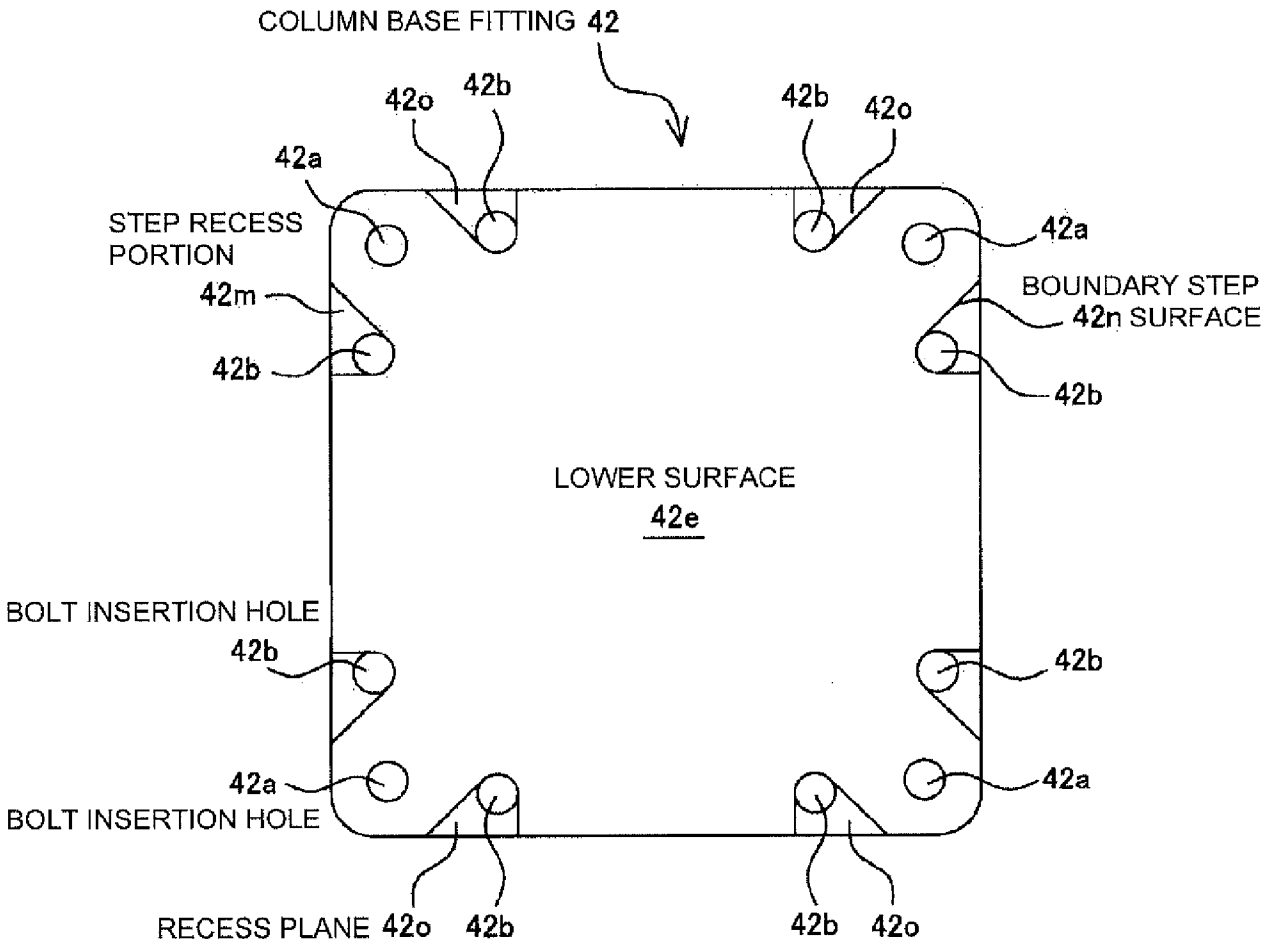
FIG. 6 is a bottom view of the column base fitting 42 illustrated in FIG. 2.

In the bottom plate 42*c* of the column base fitting 42, as illustrated in FIG. 6, a step recess portion 42*m* having a recess plane 42*o* is formed in each four corner portions of the lower surface 42*e* (back surface). The recess plane 42*o* recesses from the lower surface 42*e* toward the back side of the drawing paper in the figure. In the area of the step recess portion 42*m* of the column base fitting 42, the height thereof is formed to be lower than the height from the lower surface 42*e* to the upper surface 42*d* (refer to FIG. 3).

A boundary step surface 42*n* is formed in a step portion of the recess plane 42*o* of the step recess portion 42*m* and the lower surface 42*e*. In the boundary step surface 42*n*, the center part in length thereof abuts the inner peripheral surface of the bolt insertion hole 42*b* and both ends in length is formed extending to the outside.

Therefore, the step recess portion 42*m* is formed to be an approximately triangle shape opening from the bolt insertion hole 42*b* to the outside.

Figure 7:
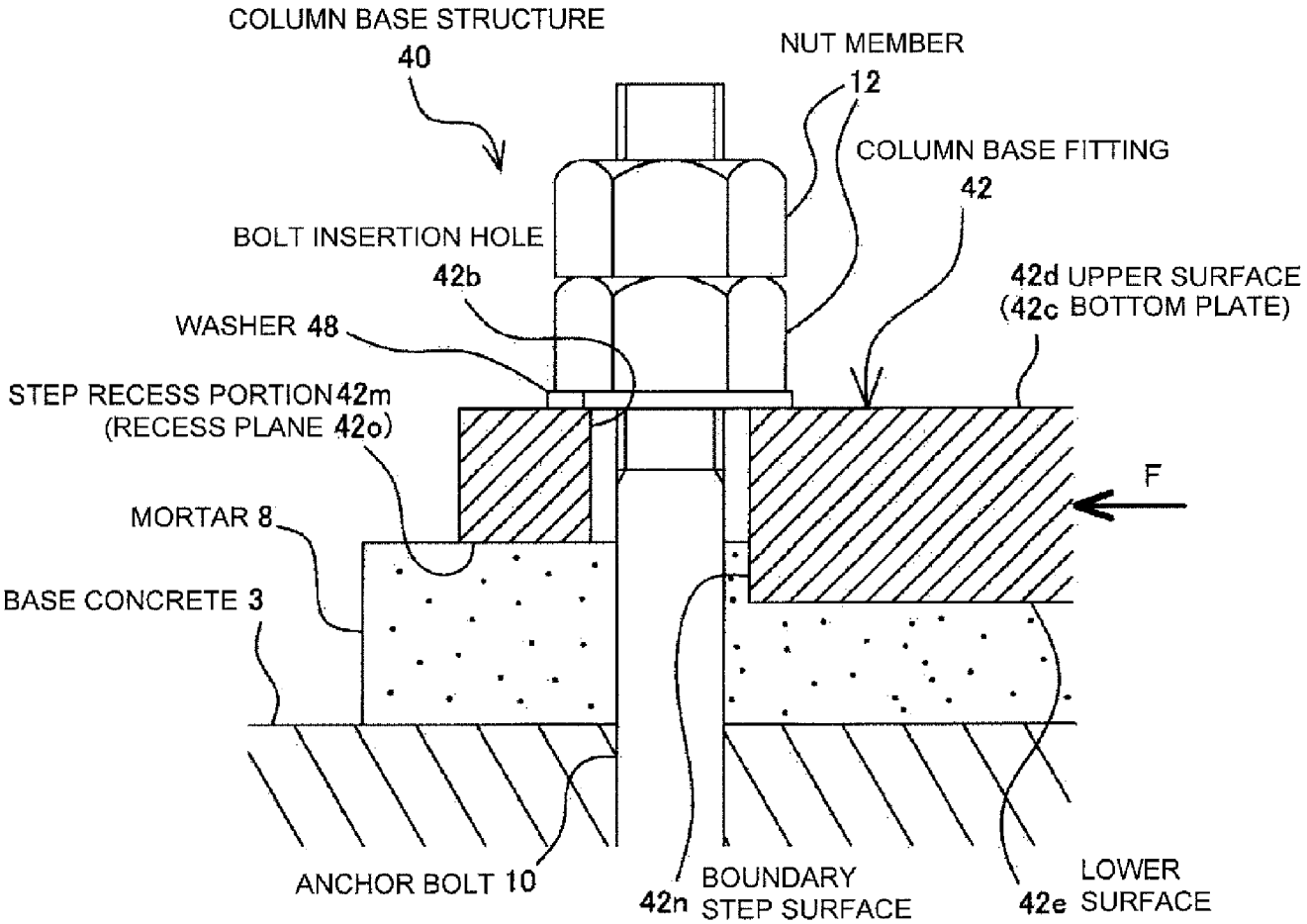
FIG. 7 is a partially enlarged cross-sectional view enlarging a joint part of an anchor bolt 10 and the column base fitting 42 in the column base structure 40 illustrated in FIG. 1.

In the column base structure 40 according to the present exemplary embodiment, the recess portion 42*i* and the inclination recess portion 42*j* illustrated in FIG. 4, the corner external inclination surface 42*k* illustrated in FIGS. 2 and 3, and the step recess portion 42*m* illustrated in FIG. 7 are formed in the column base fitting 42. Thus, the increase of size, weight, and cost of the column base fitting 42 can be prevented.

Further, in the column base structure 40 according to the present exemplary embodiment, the step recess portion 42*m* and the boundary step surface 42*n* are formed in the column base fitting 42. Thus, even when the horizontal force F (refer to FIG. 7) is applied to the column base fitting 42 by shearing force acting to the horizontal cross-section of the steel column 4 by an earthquake, etc., it can be prevented that the column base fitting 42 shifts in the horizontal direction.

Namely, as illustrated in FIG. 7, the mortar 8 filled between the lower surface 42*e* of the column base fitting 42 and the base concrete 3 is in close contact with the recess plane 42*o* of the step recess portion 42*m* and the boundary step surface 42*n*. Furthermore, the mortar 8 is filled between the recess plane 42*o* of the step recess portion 42*m* and the base concrete 3 so as to be in close contact with a part of the outer periphery of the anchor bolt 10 inserted in the bolt insertion hole 42*b*.

Therefore, as illustrated in FIG. 7, when the shearing stress acts to the steel column 4 by an earthquake, etc., the horizontal force F directing to left side in the figure is applied to the column base fitting 42. In such a case, the boundary step surface 42*n* of the column base fitting 42 acts so push each several anchor bolts 10 corresponding to the horizontal force F in the downstream side of the direction of horizontal force F, through the mortar 8. As the result, the horizontal force F is transmitted to the several anchor bolts 10.

The several anchor bolts 10 exhibits resistance force with respect to the horizontal force F, so that it can be prevented that the column base fitting 42 shifts in the horizontal direction with respect to the base concrete 3.

Furthermore, since the anchor bolts 10 receives the horizontal force F applied to the column base fitting 42 and exhibits the resistance force, it can be prevented that the horizontal force F is directly received by the mortar 8 only, so that the mortar 8 is broken.

As illustrated in FIGS. 6 and 7, the step recess portion 42*m* of the column base fitting 42 is formed to have a shape opening from the bolt insertion hole 42*b* to the outside, so that the mortar 8 can be easily filled between the column base fitting 42 and the base concrete 3.

Figure 8:
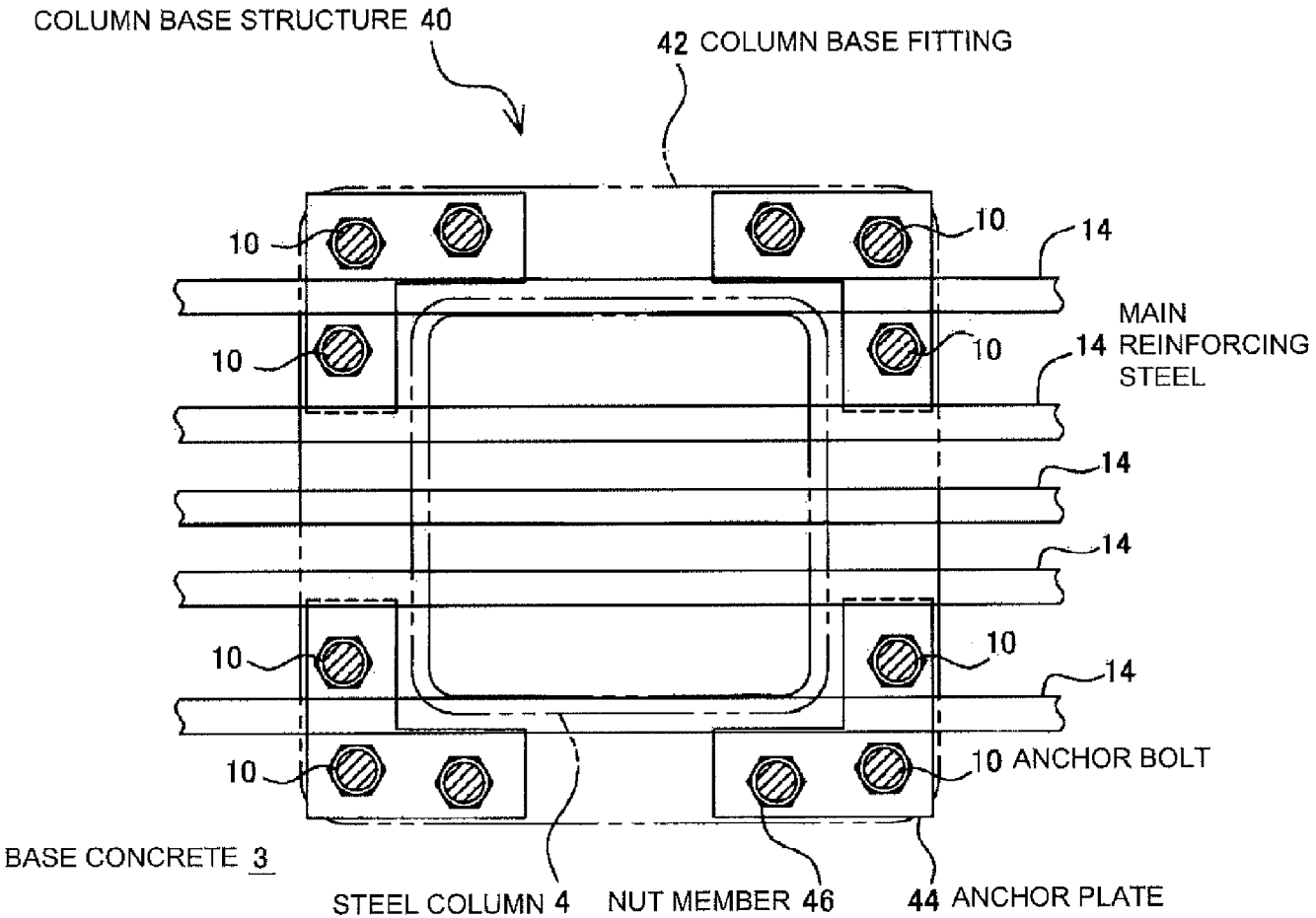
FIG. 8 is a cross-sectional view taken along a line A-A in the column base structure 40 illustrated in FIG. 1.

As illustrated in FIGS. 1 and 8, in the column base structure 40 according to the present exemplary embodiment, three anchor bolts 10 inserted in one bolt insertion hole 42*a* and two insertion holes 42*b* are fixed to one anchor plate 44 at the each lower end thereof in the base concrete 3.

As illustrated in FIG. 8, the anchor plate 44 is formed to have a L shaped plate. As illustrated in FIG. 1, in the anchor plate 44, the anchor bolt 10 is loosely inserted in a through hole 44*a* penetrating in the thickness direction. The nut member 46 is screwed with the anchor bolt 10 on the upper surface side and the lower surface side of the anchor plate 44, and thereby the anchor plate 44 is integrally fixed to the lower end of the anchor bolt 10 in the base concrete 3.

In the column base structure 40 according to the present exemplary embodiment, three anchor bolts 10 are attached to one anchor plate 44. Thus, the three anchor bolts 10 together can be fixed in the base concrete 3, and thus the attaching operation of the anchor bolts 10 can be easily performed.

Further, in the column base structure 40 according to the present exemplary embodiment, when main reinforcing steels 14 extending in the horizontal direction in FIG. 8 are arranged, a predetermined interval is formed between the anchor bolts 10 and 10 inserted in the bolt insertion holes 42*b* and 42*b*, in each side extending in the vertical direction of the column base fitting 42 in FIG. 2.

Therefore, the three main reinforcing steels 14 extending in the horizontal direction in FIG. 8 can be inserted together in the interval. Since there is no inserted anchor bolt 10 between the three main reinforcing steels 14 each, the arranging operation of the main reinforcing steels 14 can be easily performed without disturbance by the anchor bolt 10.

Further, in each side extending in the vertical direction of the column base fitting 42 in FIG. 8, the main reinforcing steel 14 extending in the horizontal direction in FIG. 8 is arranged one by one each between the anchor bolts 10 inserted in the bolt insertion hole 42*a* and bolt insertion hole 42*b*.

Further, when the main reinforcing steels 14 extending in the vertical direction in FIG. 8 (not illustrated) are arranged, the arranging operation of the main reinforcing steels 14 can be easily performed because of the same reason.

Therefore, as described above, in the column base fitting 42 and the column base structure 40 using it according to the present exemplary embodiment, the increase of size, weight, and cost of the column base fitting can be prevented.

FIG. 9 to FIG. 16 are reference views explaining a column base fitting 52 according to a second exemplary embodiment and a column base structure 50 using it.

The same parts as the column base fitting 42 and the column base structure 40 according to the first exemplary embodiment are explained by adding the same codes. The overlapped explanations about the same constitutions as the column base fitting 42 and the column base structure 40 according to the first exemplary embodiment are omitted except a part, as follows.

Figure 9:
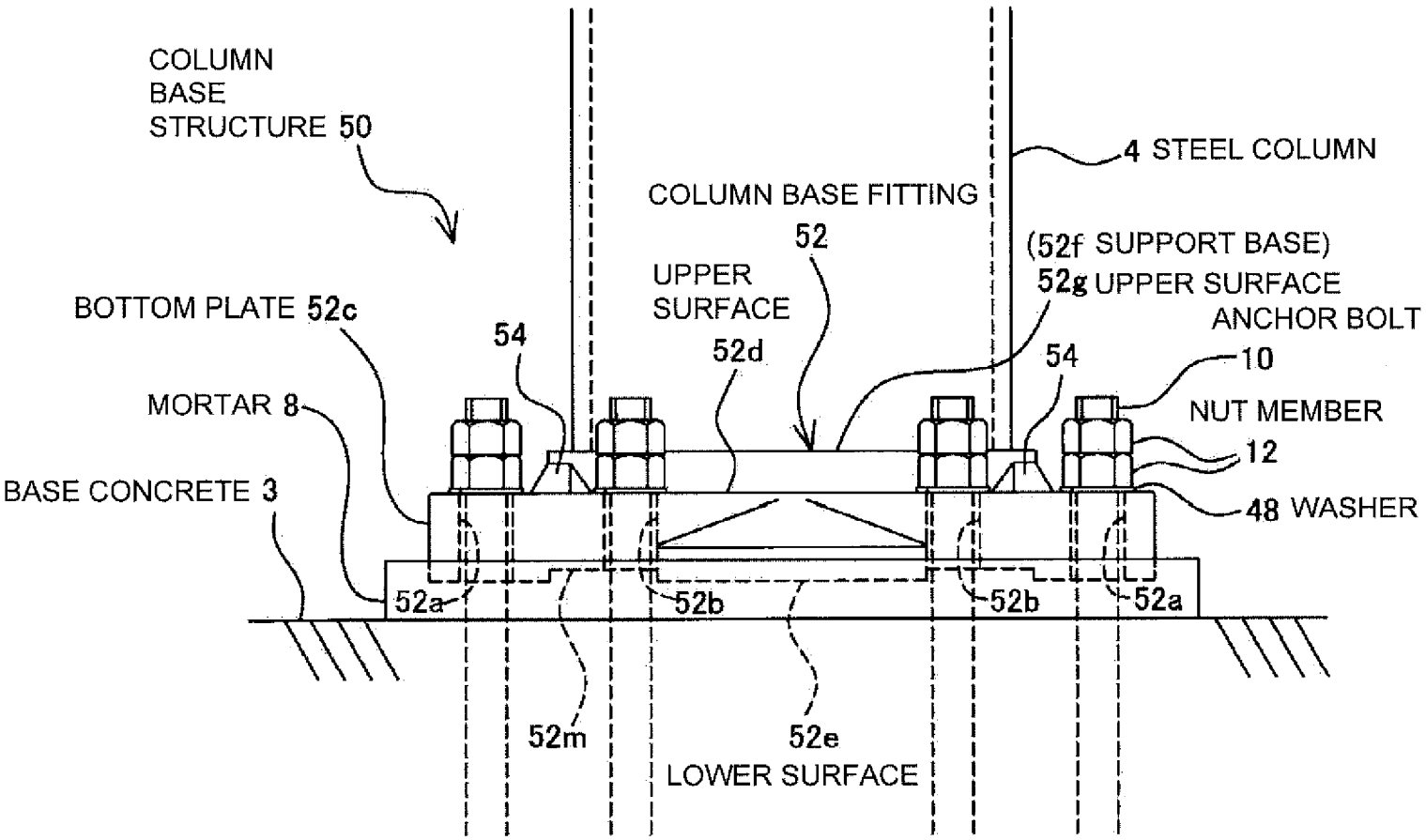
FIG. 9 is a side view illustrating the column base structure 50 according to the second exemplary embodiment of the present invention.
Figure 10:
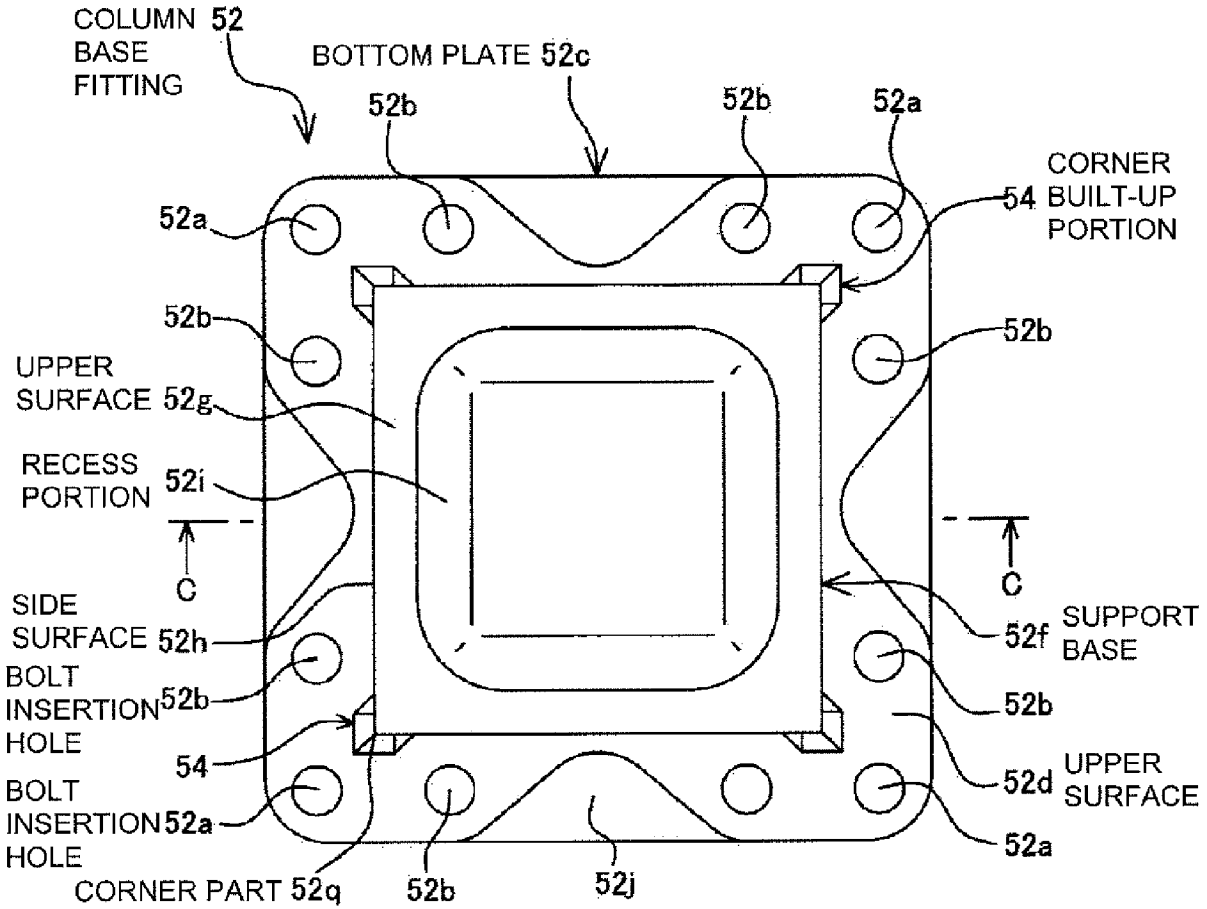
FIG. 10 is a top view illustrating the column base fitting 52 in the column base structure 50 illustrated in FIG. 9.

As illustrated in FIG. 9, a column base structure 50 according to the present exemplary embodiment includes a plate shaped column base fitting 52 (refer to FIG. 10). The column base fitting 52 is provided upward the concrete base 3 through the mortar 8.

Figure 11:
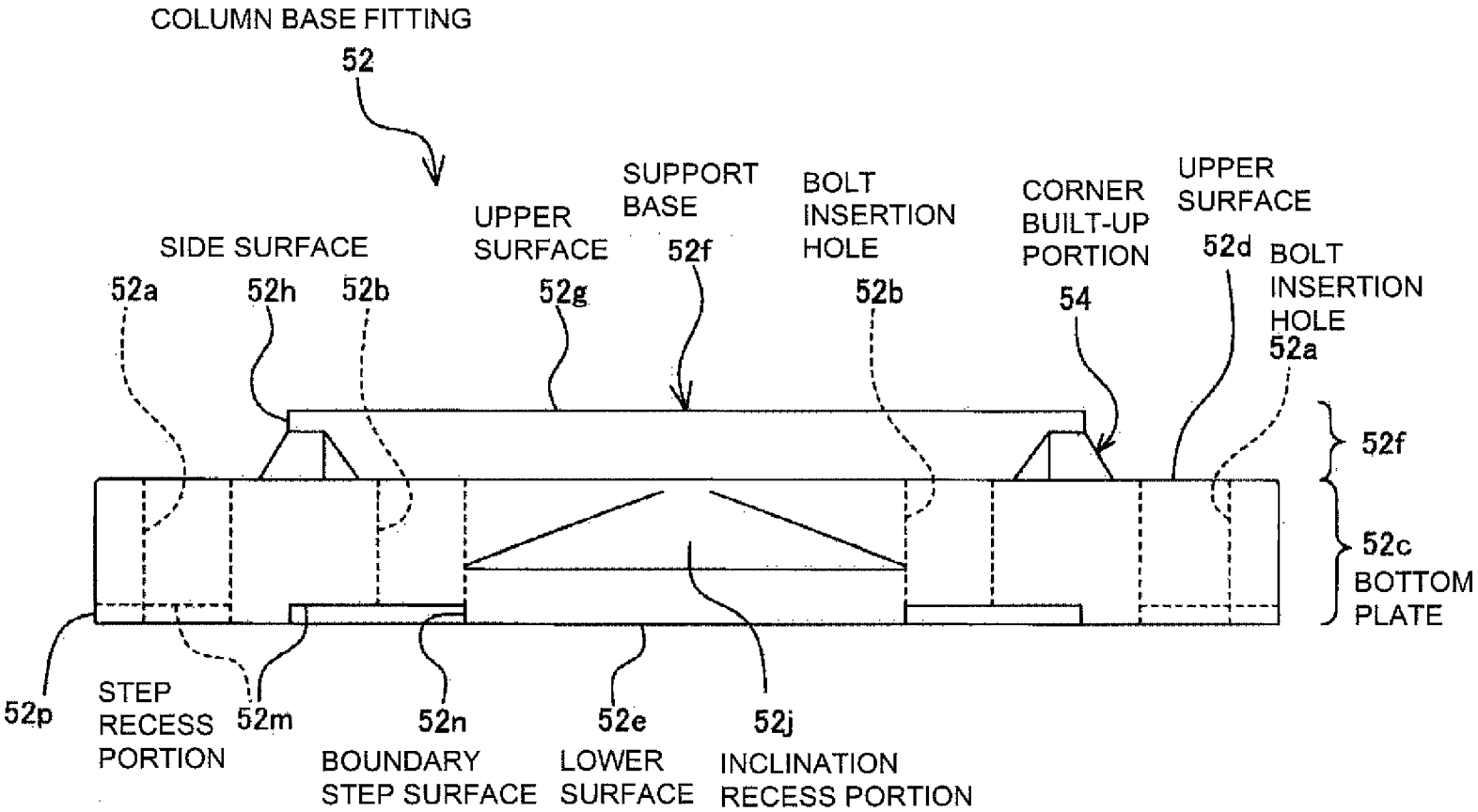
FIG. 11 is a side view of the column base fitting 52 illustrated in FIG. 10

Further, as illustrated in FIG. 11, the column base fitting 52 includes a bottom plate 52*c* and a support base 52*f*. A lower end surface of the steel column 4 (column member, refer to FIG. 9) formed to be a rectangular tube and having a length in the vertical direction in the figure abuts on an upper surface 52*g* of the support base 52*f* and each periphery is jointed by welding.

Further, the upper end of the anchor bolt 10 penetrating the mortar 8 and protruding upward from inside the base concrete 3 is inserted in a bolt insertion holes 52*a* and 52*b* formed in the bottom plate 52*c* of in the column base fitting 52 illustrated in FIGS. 10 and 11.

As illustrated in FIG. 9, a male screw part formed a top end part of the anchor bolt 10 protruding upward from an upper surface 52*d* of the bottom plate 52*c* of the column base fitting 52 is screwed with a female part in two nut members 12 (double nuts) stacked up and down. By this way, the steel column 4 is stood and fixed on the base concrete 3 through the column base fitting 52 and the mortar 8.

The column base fitting 52 is made of a metal and includes the bottom plate 52*c* formed into a plate shape and the support base 52*f*. The bottom plate 52*c* is formed to have a square shape illustrated in FIG. 10 and a height illustrated in FIG. 11. The support base 52*f* is on the center side from the external contour of the upper surface 52*d* of the bottom plate 52*c* and has a height upward in FIG. 11. The bottom plate 52*c* and the support base 52*f* are integrally formed by casting or forging together with a corner built-up portion 54 (third corner built-up portion) described later.

As illustrated in FIG. 10, an external form of the support base 52*f* of the column base fitting 52 is formed to be a slightly larger square shape than a square shape of the lower end surface of the steel column 4. The upper surface 52*g* of the support base 52*f* is formed to be an annular rectangular shape having a width inside in the perpendicular direction to each side of the support base 52*f*. As illustrated in 12, the recess portion 52*i* recessing downward in the figure is formed on the center side from the inside of the width of the annular rectangular shape of the upper surface 52*g*.

The upper surface 52*g* of the support base 52*f* is smoothly formed. The smooth lower end surface of the steel column 4 placed on the upper surface 52*g* abuts the upper surface 52*g* and each peripheral is jointed by welding.

Figure 12:
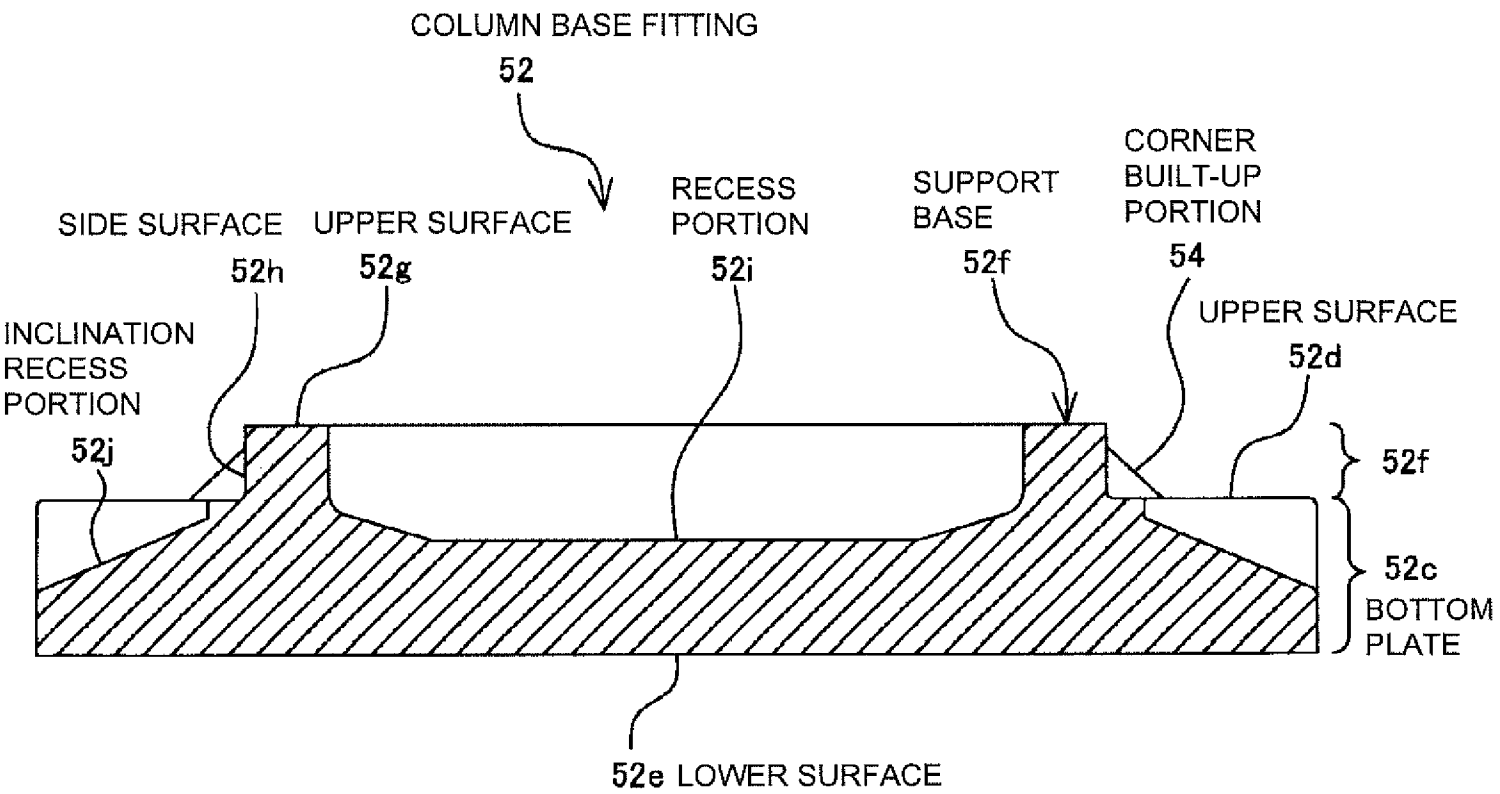
FIG. 12 is a cross-sectional view taken along a line C-C in the column base fitting 52 illustrated in FIG. 10.

Further, in the center part in the each length direction of the four sides of the bottom plate 52*c*, as illustrated in FIG. 12, an inclination recess portion 52*j* is formed to be a triangle shape as illustrated in FIGS. 10 and 11. In the inclination recess portion 52*j*, the height of the bottom plate 52*c* is gradually reduced toward the outside of the of the bottom plate 52*c* from the height on the center side of the upper surface 52*d* of the bottom plate 52*c*, as approaching the side surface of the side of the bottom plate 52*c*.

Namely, as illustrated in FIGS. 10 and 11, the inclination recess portion 52*j* is formed in an approximately triangle area surrounded by lines connecting three positions. In the four sides each of the bottom plate 52*c*, two positions are close to the two bolt insertion holes 52*b* and 52*b* each and on the lower end side in height of the bottom plate 52*c*. One position is close to the center part position in the horizontal length of the side surface 52*h* of the support base 52*f* and on the upper surface 52*d* of the bottom plate 52*c*.

As illustrated in FIG. 10, in the bottom plate 52*c*, the bolt insertion hole 52*a* (third bolt insertion hole) and the bolt insertion hole 52*b* (fourth bolt insertion hole) are formed by three in each four corner portions in total 12, the bolt insertion holes 52*a* and 52*b* passing through in the height direction of the bottom plate 52*c* (perpendicular direction with respect to the drawing paper in the figure). Each diameter of these bolt insertion holes 52*a* and 52*b* is approximately same and one anchor bolt 10 is inserted in each bolt insertion hole.

The bolt insertion hole 52*a* is formed one by one in each four corners of the square shape of the bottom plate 52*c*.

Further, two bolt insertion holes 52*b* are located at approximately close to both sides of the bolt insertion hole 52*a*. In four sides of the square shape of the bottom plate 52*c*, the two bolt insertion holes 52*b* are located at two positions closer to the center part in the length direction of the side than the bolt insertion hole 52*a* in the corner portion.

The center position of the bolt insertion hole 52*a* is located at a cross point position by two lines. One line passes two center positions of the bolt insertion holes 52*b* formed at positions of two places in the length direction of one side in the bottom plate 52*c*. Another line passes two center positions of the bolt insertion holes 52*b* formed at positions of two places in the length direction of another side close to in the perpendicular direction to the one side.

Figure 13:
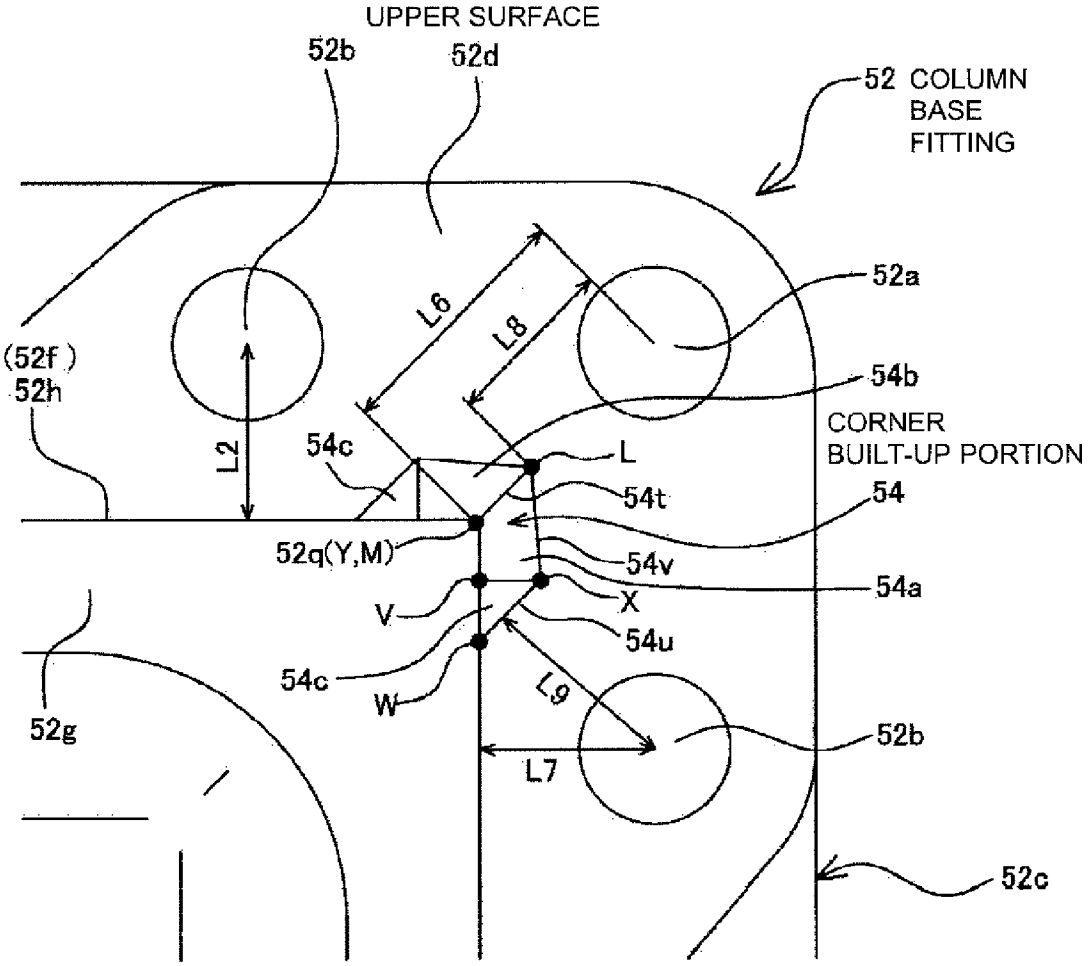
FIG. 13 is a view enlarging the upper right part of the column base fitting 52 illustrated in FIG. 10, that is, a partially enlarged top view explaining the corner built-up portion 54.

Therefore, as illustrated in FIG. 13, the length L6 is longer than the length L7. The length L6 is from the center position of the bolt insertion hole 52*a* to the lower end position in height of the corner part 52*q* in the support base 52*f* when a corner built-up portion 54 described later is not formed. The length L7 is the shortest distance from the center position of the bolt insertion hole 52*b* to the lower end in height of the side surface 52*h* in the support base 52*f*.

Further, as illustrated in FIGS. 10 and 13, in close to the four corner parts 52*q* in the support base 52*f* of the column base fitting 52, the corner built-up portion 54 is formed in the corner portion between the part close to the upper end of the side surface 52*h* and the upper surface 52*d* of the bottom plate 52*c*. The built-up portion 54 is integrally formed so as to fill the corner portion, approaching the center positions of the bolt insertion holes 52*a* and 52*b*. The corner built-up portion 54 has a boundary vertical cross-section between the side surface 52*h* of the support base 52*f* and the boundary horizontal cross-section between the upper surface 52*d* of the bottom plate 52*c*.

Figure 14:
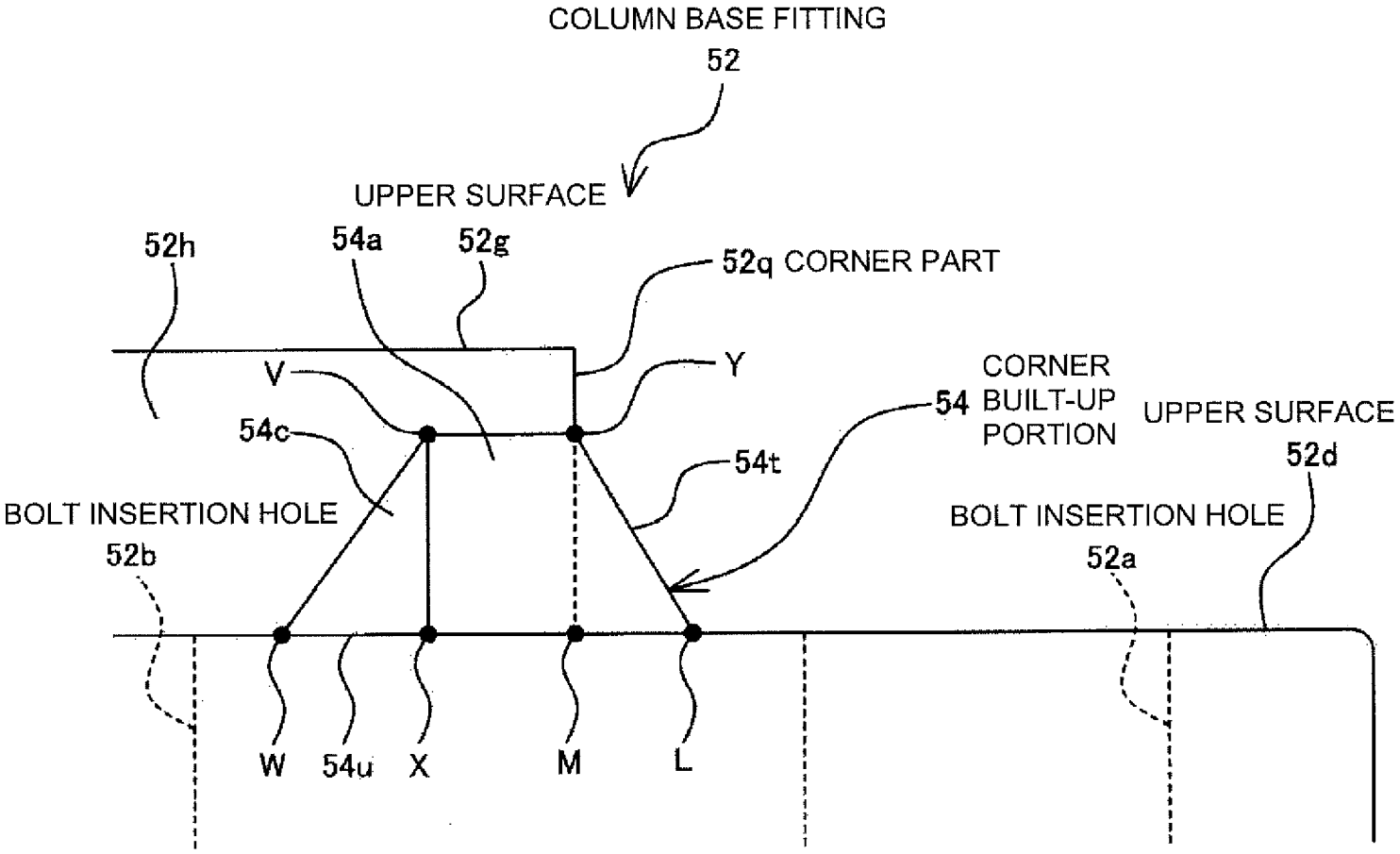
FIG. 14 is a view enlarging the upper right part of the column base fitting 52 illustrated in FIG. 11, that is, a partially enlarged side view explaining the corner built-up portion 54.

As illustrated in FIGS. 13 and 14, the corner built-up portion 54 is integrally constituted with two half built-up portions 54*a* (first protrusion portion) and 54*b* (first protrusion portion), and two built-up end portions 54*c* (second protrusion) described later. In the adjacent ends of the two side surfaces 52*h* each, which cross at the corner part 52*q* of the support base 52*f* of the column base fitting 52, the two half built-up portions 54*a* are provided inclining toward the upper surface 52*d* of the bottom plate 52*c* from the portions close to the upper ends of the side surfaces 52*h* and protruding toward the direction of the center position of the bolt insertion hole 52*a*.

Namely, in FIG. 13, the half built-up portion 54*a* is formed to have a cross-section (first vertical cross-section described later) having an approximately constant triangle shape. The cross-section is in vertical direction to the drawing paper in the figure and perpendicular to the length direction of the side surface 52*h*, in the predetermined length corresponding to a length from an apex V to an apex Y described later.

Therefore, two half built-up portions 54*a* and 54*b* have the first vertical cross-sections having the triangle shape and lengths in the same direction as the horizontal length direction of the side surfaces 52*h* of the support base 52*f*. Further, in the length direction of the side surface 52*h*, each parts extending outside from the dead-end of the side surface 52*h* is cut so as to cross each other. As the result, the half built-up portions 54*a* and 54*b* are symmetrically, integrally formed each other having a boundary of a second vertical cross-section, which is a larger triangle shape than the triangle shape of the first vertical cross-section.

Namely, the second vertical cross-section is a triangle surrounded by three points of an apex L, an apex Y, and an apex M in FIG. 14. Since the second vertical cross-section is illustrated by inclining 45 degrees in FIG. 14, the actual second vertical cross-section is longer than the length between the apex M and apex L.

Further, the built-up end portions 54*c* are formed to be approximately triangular pyramids and integrally formed between three surfaces respectively. These three surfaces include an end surface which is formed in the length direction of the side surface 52*h* and on the opposite side to parts extending outside from the end surface of the side surface 52*h*, in the length direction of each the two half built-up portions 54*a* and 54*b*, and has the same shape as the first vertical cross-section, which has the triangle shape, the side surface 52*h* of the support base 52*f*, and the upper surface 52*d* of the bottom plate 52*c*.

Namely, the two built-up end portion 54*c* are formed respectively at two positions in the corner portion between the bolt insertion holes 52*b* side of the half built-up portions 54*a* and 54*b* and the side surface 52*h* of the support base 52*f*. The two built-up end portion 54*c* are formed each other, inclining from a height position close to the upper end of the side surface 52*h* (the apex V in FIG. 14) toward the upper surface 52*d* of the bottom plate 52*c*, and approaching the direction of the center position of the bolt insertion hole 52*b*.

One apex Y of the half built-up portion 54*a* is located at a position of slightly upper side than the center position in the height direction of the corner part 52*q* of the support base 52*f*. Another apex M is located at an imaginary position at a lower end in height of the corner part 52*q* of the support base 52*f*, when the corner built-up portion 54 is not formed (refer to FIG. 14).

Further, another apex L is located on the upper surface 52*d* of the bottom plate 52*c*, protruding from the apex M to the center position of the bolt insertion hole 52*a* (refer to FIG. 13). Thus, the corner built-up portion 54 is formed so as to have a shape in which a line connecting the apex M and the apex L inclines approximately 45 degrees with respect to the length direction of the side surface 52*h* of the support base 52*f* (refer to FIG. 13).

Further, the apex L is located at a predetermined position, in which the ridge side portion 54*t* connecting the apex Y and the apex L does not abut on the nut members 12 (refer to FIG. 9) screwed with the anchor bolt 10 inserted in the bolt insertion hole 52*a*.

As illustrated in FIG. 14, another apex V of the half built-up portion 54*a* is located at the same height position as the apex Y on the side surface 52*h*, on the center part side (left side in FIG. 14) in the length direction of the side surface 52*h* from the corner part 52*q* of the support base 52*f*.

Further, the apex X is located at a position on the upper surface 52*d* of the support base 52*c*, in which the position is set to protrude toward outside in the approximately perpendicular direction with respect to the side surface 52*h* from an imaginary position at the lower end in height of the side surface 52*h* when the corner built-up portion 54 is not formed. Further, the apex W is located at the position of lower end in height of the side surface 52*h*, on the more center part side (left side in FIG. 14) in the length direction of the side surface 52*h* than the apex V.

Further, in FIG. 13, the apex W and the apex X are located at the each predetermined position on the upper surface 52*d* of the bottom plate 52*c*, in which the ridge side portion 54*u* connecting the apex W and the apex L does not abut on the nut members 12 (refer to FIG. 9) screwed with the anchor bolt 10 inserted in the bolt insertion hole 52*b*.

By the way, the half built-up portion 54*b* is formed to be a symmetrical shape with respect to the half built-up portion 54*a* concerning the second vertical cross-section of the triangle shape having the ridge side portion 54*t*.

As described above, in the corner built-up portion 54, the top end of the ridge side portion 54*t* is formed to protrude from the corner part 52*q* of the support base 52*f* to the center position of the bolt insertion hole 52*a*.

Therefore, a length L8 is shorter than a length L6. The length L8 is from the apex L of the corner built-up portion 54 to the center position of the bolt insertion hole 52*a*. The length L6 is from the lower end position in height of the corner part 52*q* of the support base 52*f* to the center position of the bolt insertion hole 52*a* when the corner built-up portion 54 is not formed.

Further, a length L9 is shorter than a length from the center position of the bolt insertion hole 52*b* to the lower end position in height of the side surface 52*h* of the support base 52*f* when the corner built-up portion 54 is not formed. The length is in the same direction as the length L9. The length L9 is the shortest distance from the center position of the bolt insertion hole 52*b* to the ridge side portion 54*u* of the corner built-up portion 54.

Further, at a predetermined position on the ridge side portion 54*v* (refer to FIG. 13) connecting the apex L and the apex X of the corner built-up portion 54, a length of the distance from the center position of the bolt insertion hole 52*a* is shorter than a length from the center position of the bolt insertion hole 52*a* to the lower end position in height of the side surface 52*h* of the support base 52*f*, which is the same direction as the above length, when the corner built-up portion 54 is not formed.

As described above, for withstanding the bending moment transmitted from the steel column 4, the thickness of the bottom plate 52*c* needs to be set, proportioning to the length of the shortest distance from the center positions of the bolt insertion holes 52*a* and 52*b* to the lower end position in height of the support base 52*f*.

Therefore, when the corner built-up portion 54 is formed on the support base 52*f* of the column base fitting 52, the lengths of the shortest distance from the center positions of the bolt insertion holes 52*a* and 52*b* to the lower end position in height of the support base 52*f* are shorten, so that it can be prevented that the thickness of the bottom plate 52*c* becomes thick.

Thus, in the column base structure 50 according to the present exemplary embodiment, since the corner built-up portion 54 is formed in the column base fitting 52, the rigidity at the lower end position in height of the side surface 52*h* of the support base 52*f* in the bottom plate 52*c* can be increased by necessary amount at the necessary position.

Namely, by partially reinforcing a part having low rigidity in the column base fitting 52 to increase the rigidity by the corner built-up portion 54, it can be prevented that the thickness of the bottom plate of the column base fitting increases in comparison with the case that the corner built-up portion 54 is not formed. Thus, the increase of size, weight, and cost of the column base fitting 52 can be prevented.

Further, as illustrated in FIG. 13, the length L8 is set to be almost same as the length L7. The length L8 is from the center position of the bolt insertion hole 52*a* to the position of the apex L. The length L7 is the shortest distance from the center position of the bolt insertion hole 52*b* to the lower end position in height of the support base 52*f*.

Further, as illustrated in FIG. 13, the length L8 is slightly shorter than the length L9 in the figure. The length L8 is from the center position of the bolt insertion hole 52*a* to the position of the apex L. The length L9 is the shortest distance from the center position of the bolt insertion hole 52*b* to the ridge side portion 54*u* of the corner built-up portion 54. However, the difference of the length L8 and the length L9 is small.

Since the corner built-up portion 54 is formed on the support base 52*f* of the column base fitting 52, the difference of the lengths of the shortest distances from the each center position of the bolt insertion holes 52*a* and 52*b* to the lower end position of the support base 52*f* becomes small.

As described above, the stress applying to the bottom plate 52*c* by the bending moment transmitted from the steel column 4 is proportional to the length from the center positions of the bolt insertion holes 52*a* and 52*b* to the lower end position in height of the support base 52*f* on which the corner built-up portion 54 is formed.

Therefore, by equalizing the length, it can be prevented that the bending deformation in the corner portion of the square shape of the bottom plate 52*c*, on which the bolt insertion hole 52*a* is formed, becomes larger than the bending deformation in a part close to the center part in length of the side of the bottom plate 52*c*, in which the bolt insertion hole 52*b* is formed.

Namely, the bending deformation of the corner portion of the square shape of the bottom plate 52*c*, in which the bolt insertion hole 52*a* is formed, can be reduced to the approximately same extent as the bending deformation in a part close to the center part in length of the side of the bottom plate 52*c*, in which the bolt insertion hole 52*b* is formed. Thus, the flexural capacity of the entirety of the column base fitting 52 containing the corner portion can be improved.

In the present exemplary embodiment, when the anchor bolt 10 having a standard diameter size (about 400 to 800 mm) is used, the length of a line (refer to FIGS. 13 and 14), which connects the lower end position in height of the corner part 52*q* of the support base 52*f* (the apex M of the corner built-up portion 54) and the apex L of the corner built-up portion 54, is preferably 0.6 times the diameter length of the anchor bolt 10.

Making the length of the line connecting the apex M and apex L of the corner built-up portion 54 to be 0.6 times the diameter length of the anchor bolt 10, the length L8 is approximately equal to the length L7. The length L8 is from the center position of the bolt insertion hole 52*a* to the position of the apex L. The length L7 is the shortest distance from the center position of the bolt insertion hole 52*b* to lower end position in height of the support base 52*f*.

Since, the center position of the bolt insertion hole 52*a* is located at the position mentioned above in the four corner portions of the square shape of the bottom plate 52*c*, the interval between the anchor bolt 10 inserted in the bolt insertion hole 52*a* and the anchor bolt 10 inserted in the bolt insertion hole 52*b* is larger than the interval when the center position of the bolt insertion hole 52*a* is located to be closer to the corner part 52*q* than the above position.

Therefore, when the main reinforcing steel not illustrated is arranged between the anchor bolts 10 and 10, which are inserted in the bolt insertion holes 52*a* and 52*b*, the arranging operation can be easily performed because being hard to be disturbed by the anchor bolts 10.

Figure 15:
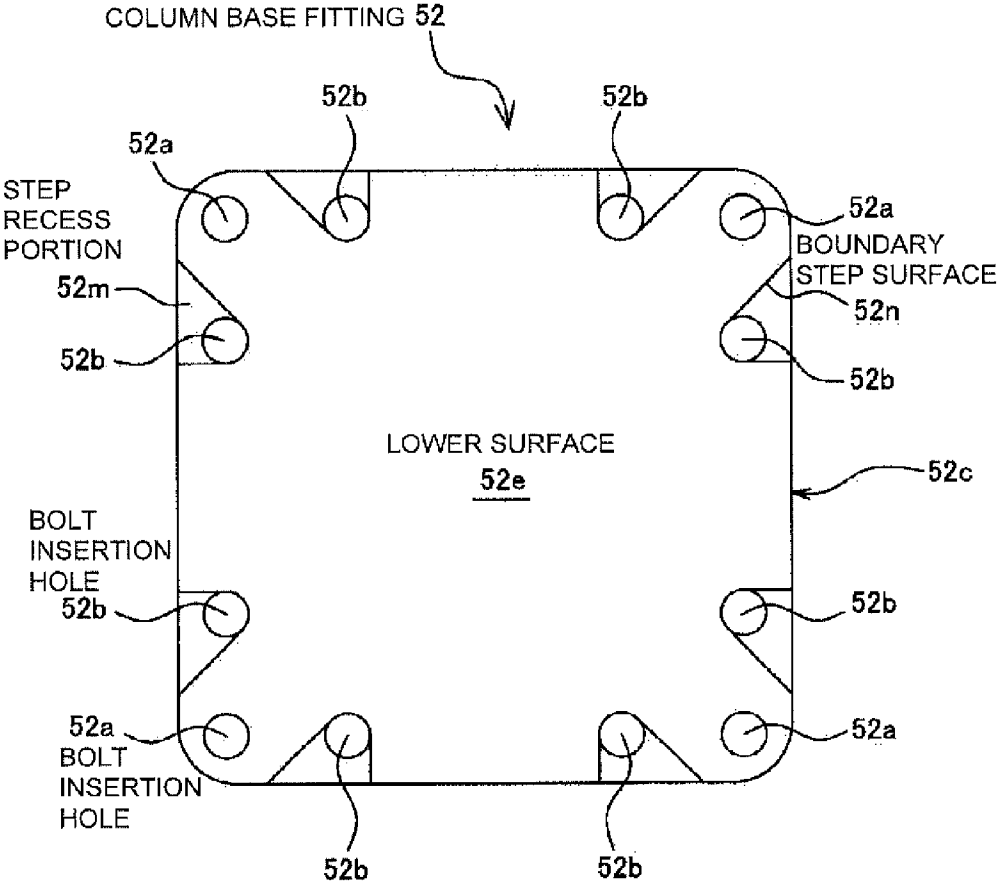
FIG. 15 is a bottom view of the column base fitting 52 illustrated in FIG. 10.
Figure 16:
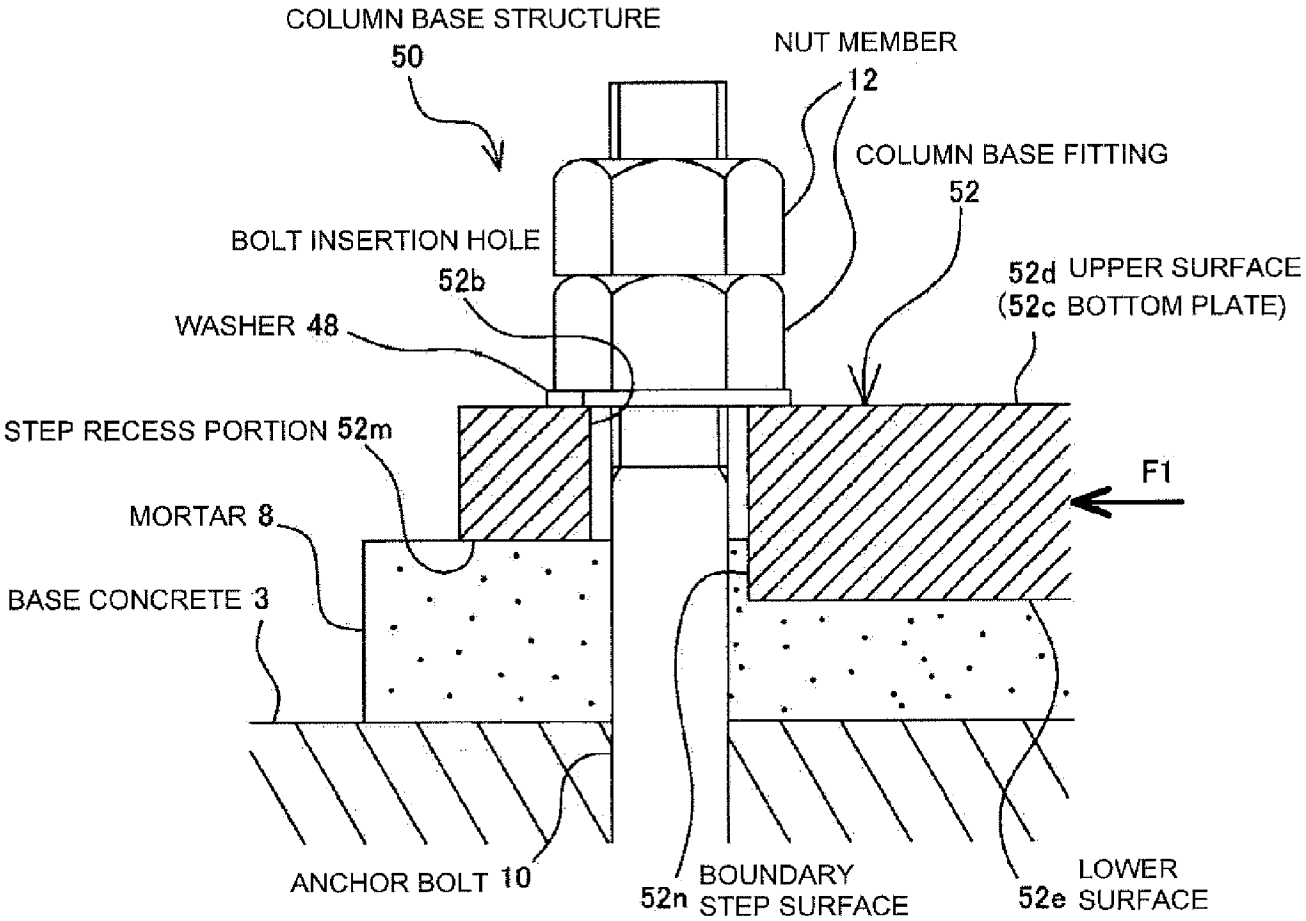
FIG. 16 is a partially enlarged cross-sectional view enlarging a joint part of an anchor bolt 10 and the column base fitting 52 in the column base structure 50 illustrated in FIG. 9.

In the bottom plate 52*c* of the column base fitting 52, as illustrated in FIG. 15, in the four corner portions each on the lower surface 52*e* (back surface) thereof, a step recess portion 52*m* having a recess plane recessing toward the back side of the paper surface in the figure from the lower surface 52*e* is formed. The height of the area of the step recess portion 52*m* in the column base fitting 52 is formed to be lower than the height from the lower surface 52*e* to the upper surface 52*d* (refer to FIG. 11).

In the both ends of a step portion of the recess plane forming the step recess portion 52*m* and lower surface 52*e*, a boundary step surface 52*n* is formed. The boundary step surface 52*n* is formed to have a shape that the end of the inside thereof abuts on the inner periphery of the bolt insertion hole 52*b* and the both end of the outside thereof opens toward the outside.

Thus, the step recess portion 52*m* is formed to be an approximately triangle shape opening from the bolt insertion hole 52*b* toward the outside.

In the column base structure 50 according to the present exemplary embodiment, the recess portion 52*i* and the inclination recess portion 52*j* illustrate in FIG. 12, and the step recess portion 52*m* shown in FIG. 15 are formed in the column base fitting 52. Thus, the increase of size, weight, and cost of the column base fitting 52 can be prevented.

Further, in column base structure 50 according to the present exemplary embodiment, the step recess portion 52*m* and the boundary step surface 52*n* are formed in the column base fitting 52. Thus, even when the horizontal force F1 (refer to FIG. 16) is applied to the column base fitting 52, it can be prevented that the column base fitting 52 is shifted in the horizontal direction, due to the same reason in the column base structure 40 according to the first exemplary embodiment. The horizontal force F1 generates by sharing force acting to the horizontal cross-section of the steel column 4 by an earthquake, etc.

Further, it can be prevented that the mortar 8 is broken, due to the same reason in the column base structure 40 according to the first exemplary embodiment.

Further, the mortar 8 can be easily filled between the column base fitting 52 and the base concrete 3, due to the same reason in the column base structure 40 according to the first exemplary embodiment.

Accordingly, as described above, in the column base fitting 52 according to the present embodiment and the column base structure 50 using it, the entire flexural capacity of the column base fitting 52 containing the corner portions can be increased and the increase of size, weight, and cost of the column base fitting 52 can be prevented.

Figure 17:
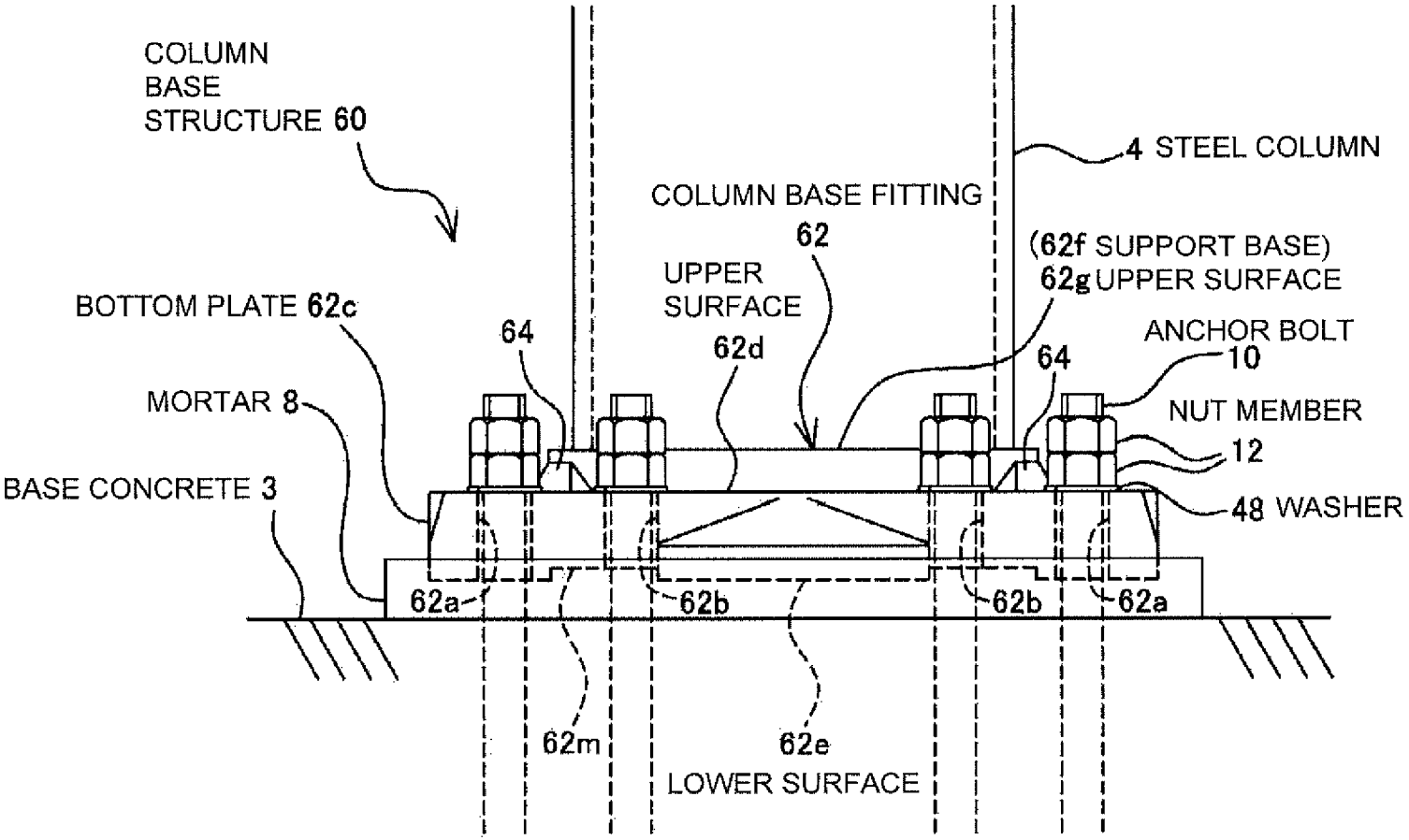
FIG. 17 is a side view of the column base structure 60 according to the third exemplary embodiment of the present invention.
Figure 18:
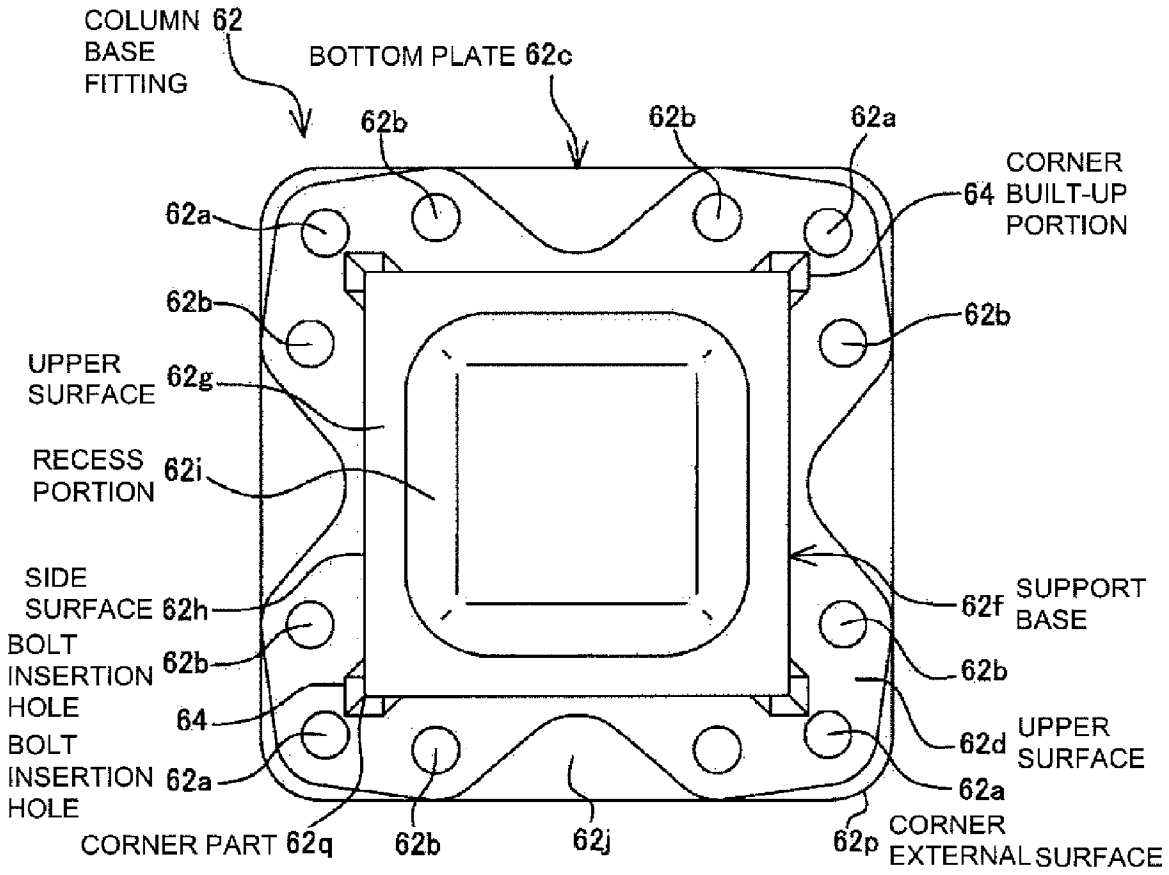
FIG. 18 is a top view of the column base fitting 62 in the column base structure 60 illustrated in FIG. 17.
Figure 19:
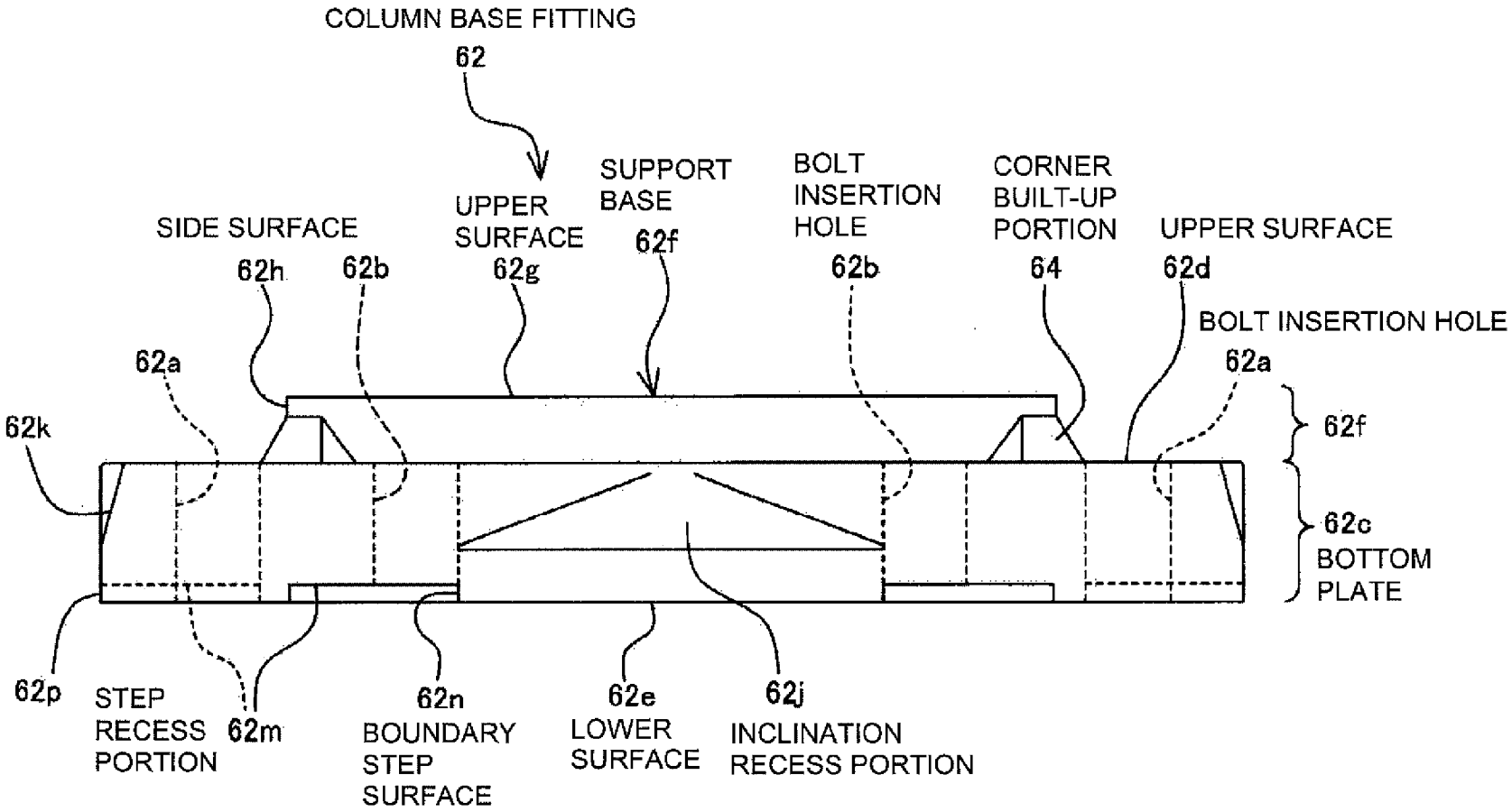
FIG. 19 is a side view of the column base fitting 62 illustrated in FIG. 18.

FIG. 17 to FIG. 19 are views explaining a column base structure 60 according to a third exemplary embodiment.

The same parts as the column base fitting 52 and the column base structure 50 according to the second exemplary embodiment are added with the same codes and the overlapped explanations about the same constitutions of the column base fitting 52 and the column base structure 50 according to the second exemplary embodiment are omitted as follows except a part thereof.

The column base structure 60 according to the present exemplary embodiment, as illustrated in FIG. 17, includes a column base fitting 62 instead of the column base fitting 52 in the second exemplary embodiment. This is a different point from the column base structure 50 in the second exemplary embodiment. The other constitutions are the same as the column base structure 50 in the second exemplary embodiment.

Namely, in the column base fitting 52, the triangle formed by lines connecting three points of the center position of the bolt insertion hole 52*a* and two center positions of the bolt insertion holes 52*b* adjacent to the bolt insertion hole 52*a* is approximately a right-angled triangle. On the other hand, in the column base fitting 62, a triangle formed by lines connecting three points of the center position of the bolt insertion hole 52*a* and two center positions of the bolt insertion holes 52*b* adjust the bolt insertion hole 52*a* is an obtuse triangle.

In the column base structure 50, the center position of the bolt insertion hole 52*a* in the column base fitting 52 is located at the cross point position of two lines. One line passes the two center positions of the bolt insertion holes 52*b* formed at positions of two places in the length direction of one side of the bottom plate 52*c*. Another line passes the two center positions of the bolt insertion holes 52*b* formed at positions of two places in the length direction on an adjacent side in the perpendicular direction to the one side of the bottom plate 52*c*.

On the other hand, in the column base structure 60, the center position of the bolt insertion hole 62*a* is located at a place slightly shifted to closer to the corner part 62*q* (close to the center part) of the support base 62*f* than the cross point (refer to FIG. 18).

In the bottom plate 62*c* of the column base fitting 62, a corner external inclination surface 62*k* is formed on the upper side in the height direction in FIG. 19, in the four corner portions illustrated in FIG. 18.

The corner external inclination surface 62*k* is formed inclining from a corner external surface 62*p* positioned on the lower side in the height direction in the figure toward the position close to the center part of the upper surface 62*d* of the bottom plate 62*c*.

The height from the lower end of the corner external inclination surface 62*k* to the lower end of the corner external surface 62*p* on the lower side is set to be approximately half of the entire height from the upper surface 62*d* of the bottom plate 62*c* to the lower surface 62*e*. This is the different point from the column base fitting 52.

Also in the column base structure 60 according to the present exemplary embodiment, the same effect as the column base structure 50 in the second exemplary embodiment can be obtained.

Further, in the column base structure 60 according to the present exemplary embodiment, the center position of the bolt insertion hole 62*a* in the column base fitting 62 is slightly shifted to the position close to the corner part 62*q* of the support base 62*f* from the position corresponding to the center position of the bolt insertion hole 52*a* in the column base fitting 52. Thus, the length of the shortest distance from the center position of the bolt insertion hole 62*a* to a corner built-up portion 64 (third corner built-up portion) is shortened more.

As described above, for withstanding the bending moment transmitted from the steel column 4, the thickness of the bottom plate 62*c* is set in proportion to the length from the center positions of the bolt insertion holes 62*a* and 62*b* to the lower end position in height of the support base 62*f* on which the corner built-up portion 64 is formed.

Therefore, it is possible to make the length of the shortest distance from the center position of the bolt insertion hole 62*a* to the corner built-up portion 64 to be shorter than the length L8 described in FIG. 13 in the second exemplary embodiment. Thus, the thickness of the bottom plate 62*c* of the column base fitting 62 can be thinner than the thickness of the bottom plate 52*c* of the column base fitting 52 according to the second exemplary embodiment.

Therefore, by making the thickness of the bottom plate 62*c* of the column base fitting 62 to be thinner than the thickness of the bottom plate 52*c* of the column base fitting 52 according to the second exemplary embodiment, the increase of size, weight, and cost of the column base fitting 62 can be prevented more.

Further, in the column base structure 60 according to the present exemplary embodiment, since the corner external inclination surface 62*k* is formed in the column base fitting 62 in addition to the recess portion 62*i*, the inclination recess portion 62*j*, the step recess portion 62*m*. Thus, the increase of size, weight, and cost of the column base fitting 62 can be prevented more.

In addition, in the column base structures 40, 50, and 60 according to the first to the third exemplary embodiment, the case that the column base fittings 42, 52, and 62 have the square shape is described. However, the shape is not limited in the square shape, but can be a rectangular shape having different length in the vertical and horizontal direction other than the square shape.

Further, in the column base fitting 42 according to the first exemplary embodiment, the case that totally 12 bolt insertion holes 42*a* and 42*b* penetrating in the thickness direction are formed is described. However, the number of the bolt insertion holes 42*a* and 42*b* formed in the column base fitting is not limited. The holes more than 12 can be used.

For example, in the range that the anchor bolt 10 does not abut on the corner built-up portions 42*r* and 42*s*, two bolt insertion holes 42*a* can be formed in the four corner portions each of the column base fitting 42. Further, one or more bolt insertion holes can be formed between the bolt insertion hole 42*a* and the bolt insertion hole 42*b*.

Further, in the column base fittings 42, 52, and 62 according to the first to the third exemplary embodiments, the step recess portions 42*m*, 52*m*, and 62*m* are formed in the four corner portions each on the lower surfaces 42*e*, 52*e*, and 62*e* of the bottom plate 42*c*, 52*c*, and 62*c*. However, the step recess portions 42*m*, 52*m*, and 62*m* can not be formed in any corner portions on the lower surfaces 42*e*, 52*e*, and 62*e* of the bottom plate 42*c*, 52*c*, and 62*c*.

Further, in the column base fitting 42 according to the first exemplary embodiment, the anchor plate 44 is formed to be the L-shaped plate. However, the anchor plate 44 can be formed to be one plate having a quadrangular shape. In such a case, 12 anchor bolts 10 can be fixed in the one anchor plate. In another case, each one anchor plate can be fixed to one anchor bolt 10.

Further, in the column base structures 40 according to the first exemplary embodiment, as illustrated in FIG. 8, three main reinforcing steels 14 are arranged between the anchor bolts 10 and 10, which are inserted in two bolt insertion holes 42*b* in one side. If possible, four or more main reinforcing steels 14 can be arranged between the anchor bolts 10 and 10.

Further, in the column base structures 40 according to the first exemplary embodiment, as illustrated in FIG. 8, one main reinforcing steel 14 is arranged between the anchor bolts 10 and 10, which are inserted in the bolt insertion hole 42*a* and the bolt insertion hole 42*b* in one side. If possible, two or more main reinforcing steel 14 can be arranged between such the anchor bolts 10 and 10.

Further, in the column base structures 40, 50, and 60 according to the first to third exemplary embodiments, the steel column 4, in which the lower end surface thereof is jointed to the column base fittings 42, 52, and 62 is formed to be a square tube. However, the shape of the steel column 4 is not limited in this shape and, for example, a circular tube can be used. Further, the shape of the support base 42*f*, 52*f*, and 62*f* of the column base fitting 42, 52, and 62 can be changed corresponding to the shape of the steel column 4.

Further, when the shapes of the support base 42*f*, 52*f*, and 62*f* are change to a circular tube, in the planar cross-section of the column base structure 40, 50 and 60, the shortest distance parts from the center positions of the bolt insertion holes 42*a*, 52*a*, and 62*a*, on the outer periphery of the circular shape of the support bases 42*f*, 52*f*, and 62*f*, can be regarded as the corner part 42*q*, 52*q*, and 62*q* in the first to the third exemplary embodiments.

Further, in the column base fitting 42 according to the first exemplary embodiment, the corner built-up portions 42*r* and 42*s* is formed to be an approximately triangular pyramid shape. However, the shape is not limited. For example, a triangular column, a square pyramid, a square column, a polygonal pyramid, a polygonal column, a ball shape, an ellipsoid, and any other shape can be formed.

Further, in the column base fittings 52 and 62 according to the second and the third exemplary embodiments, the corner built-up portions 54 and 64 include two half built-up portions and built-up end portion. However, the shape of the built-up portions 54 and 64 is not limited, if the two lengths are equalized in such a shape. One length is from the center positions of the bolt insertion holes 52*a* and 62*a* to the lower end position in height of the corner built-up portions 54 and 64. Another length is from the center positions of the bolt insertion holes 52*b* and 62*b* to the lower end position in height of the side surfaces 52*h* and 62*h* of the support base 52*f* and 62*f*.

Further, in the column base fitting 42 according to the first exemplary embodiment, both the corner built-up portion 42*r* and the corner built-up portion 42*s* are formed on the side surface 42*h* of the support base 42*f*. However, it may be either one. For example, only one of the corner built-up portion 42*r* and the corner built-up portion 42*s* can be formed.

Further, in the column base fittings 52 and 62 according to the second and the third exemplary embodiment, the corner built-up portions 54 and 64 are formed only in the vicinity of the corner part 52*q* and 62*q* of the support base 52*f* and 62*f*. However, the other corner built-up portions can be formed in the other place. For example, another corner built-up portion can be formed protruding from the close to the center part in the length direction of the side surface 52*h* and 62*h* of the support base 52*f* and 62*f* to the center position of the bolt insertion holes 52*b* and 62*b*, in addition to the corner built-up portions 54 and 64.

Further, in the column base fitting 42 according to the first exemplary embodiment, the apex H and the apex Q (refer to FIG. 4) of the corner built-up portions 42*r* and 42*s* are located at the position on the upper side from the center part in the height direction of the side surface 42*h* of the support base 42*f*. However, the position is not limited. For example, the apex H and the apex Q can be located in an upper end position in height of the side surface 42*h* of the support base 42*f*.

Similarly, in the column base fitting 52 according to the second exemplary embodiment, the apex Y and the apex V (refer to FIG. 14) of the corner built-up portion 54 is located in the position on the upper side from the center part in the height direction of the side surface 52*h* of the support base 52*f*. However, the position is not limited. For example, the apex Y and the apex V can be located in the upper end position in height of the side surface 52*h* of the support base 52*f*.

Furthermore, the column base fittings 42, 52, and 62 according to the first to the third exemplary embodiments, the corner built-up portions 42*r*, 42*s*, 54, and 64 are integrally formed with the support bases 42*f*, 52*f*, and 62*f* and the bottom plates 42*c*, 52*c*, and 62*c* by casting. However, the corner built-up portions can be integrally formed with the support bases 42*f*, 52*f* and 62*f* and the bottom plates 42*c*, 52*c* and 62*c* by welding, etc. In such a process, a welding material is served so as to fill the corner portion between the side surfaces 42*h*, 52*h*, and 62*h* and the upper surface 42*d*, 52*d*, and 62*d*.

What is claimed is:

1. A column base fitting comprising;

a bottom plate formed as an approximately square shape, both surfaces of upper and lower, and thickness, and a support base inside from a peripheral portion of an upper surface of the bottom plate and extending upward in height, wherein a lower end portion of a column member is jointed on an upper surface of the support base, wherein a first bolt insertion hole is formed at a position of each four corner portions of the square shape, wherein a second bolt insertion hole is formed at two positions closer to a center part of the bottom plate than the first bolt insertion hole in the direction of each four sides of the square shape, wherein a first corner built-up portion is located at a corner of the support base wherein the corner is the intersection of two sides of the support base and is formed to have such a shape as to protrude outward in the perpendicular direction from the side surface, in both ends in the direction of a side surface of the support base, but not protrude in a diagonal direction of the bottom plate from a corner portion of the support base, and wherein the first corner built-up portion fills the corner portion between the side surface and an upper surface of the bottom plate.

2. The column base fitting according to claim 1, wherein a length from the center position of the first bolt insertion hole to a lower end position of a corner part of the support base, and a length of the shortest distance from the center position of the second bolt insertion hole to a lower end position of the first corner built-up portion, are approximately same.

3. The column base fitting according to claim 2, wherein a second corner built-up portion is formed to have a shape protruding outward in the perpendicular direction from the side surface, at two positions closer to the center part than the first corner built-up portion in the direction of the side surface of the support base, and wherein the second corner built-up portion fills the corner portion between the side surface and an upper surface of the bottom plate.

4. The column base fitting according to claim 3, wherein a length from a center position of the first bolt insertion hole to the lower end position of the corner part of the support base, and a length of the shortest distance from a center position of the second bolt insertion hole to the lower end position of the second corner built-up portion, are approximately same.

5. The column base fitting according to claim 3, wherein a length of the shortest distance from the center position of the second bolt insertion hole to the lower end position of the first corner built-up portion, a length of the shortest distance from the center position of the second bolt insertion hole to the lower end position of the second corner built-up portion, and a length from the center position of the second bolt insertion hole to a lower end position of the side surface of the shortest distance, are approximately same.

6. The column base fitting according to claim 1, wherein a second corner built-up portion is formed to have a shape protruding outward in the perpendicular direction from the side surface, at two positions closer to the center part than the first corner built-up portion in the direction of the side surface of the support base, and wherein the second corner built-up portion fills the corner portion between the side surface and an upper surface of the bottom plate.

7. The column base fitting according to claim 6, wherein a length from a center position of the first bolt insertion hole to the lower end position of the corner part of the support base, and a length of the shortest distance from a center position of the second bolt insertion hole to the lower end position of the second corner built-up portion, are approximately same.

8. The column base fitting according to claim 6, wherein a length of the shortest distance from the center position of the second bolt insertion hole to the lower end position of the first corner built-up portion, a length of the shortest distance from the center position of the second bolt insertion hole to the lower end position of the second corner built-up portion, and a length from the center position of the second bolt insertion hole to a lower end position of the side surface of the shortest distance, are approximately same.

9. The column base fitting according to claim 6, wherein a length from the center position of the first bolt insertion hole to a lower end position of a corner part of the support base, and a length of the shortest distance from the center position of the second bolt insertion hole to a lower end position of the side surface of the support base, are approximately same.

10. The column base fitting according to claim 9, wherein a length from the center position of the first bolt insertion hole to a lower end position of a corner part of the support base, and a length of the shortest distance from the center position of the second bolt insertion hole to a lower end position of the first corner built-up portion, are approximately same.

11. The column base fitting according to claim 9, wherein a length from the center position of the first bolt insertion hole to a lower end position of a corner part of the support base, and a length of the shortest distance from the center position of the second bolt insertion hole to a lower end position of the second corner built-up portion, are approximately same.

12. The column base fitting according to claim 6, wherein a length of the shortest distance from the center position of the second bolt insertion hole to a lower end position of the first corner built-up portion, and a length of the shortest distance from the center position of the second bolt insertion hole to a lower end position of the side surface of the support base, are approximately same.

13. The column base fitting according to claim 6, wherein a length of the shortest distance from the center position of the second bolt insertion hole to a lower end position of the first corner built-up portion, and a length of the shortest distance from the center position of the second bolt insertion hole to a lower end position of the second corner built-up portion, are approximately same.

14. The column base fitting according to claim 6, wherein a length of the shortest distance from the center position of the second bolt insertion hole to a lower end position of the side surface of the support base, and a length of the shortest distance from the center position of the second bolt insertion hole to a lower end position of the second corner built-up portion, are approximately same.

15. The column base fitting according to claim 1, wherein a length from the center position of the first bolt insertion hole to a lower end position of a corner part of the support base, and a length of the shortest distance from the center position of the second bolt insertion hole to a lower end position of the side surface of the support base, are approximately same.

16. The column base fitting according to claim 15, wherein a length from the center position of the first bolt insertion hole to a lower end position of a corner part of the support base, and a length of the shortest distance from the center position of the second bolt insertion hole to a lower end position of the first corner built-up portion, are approximately same.

17. The column base fitting according to claim 15, wherein a length from the center position of the first bolt insertion hole to a lower end position of a corner part of the support base, and a length of the shortest distance from the center position of the second bolt insertion hole to a lower end position of the second corner built-up portion, are approximately same.

18. The column base fitting according to claim 1, wherein a length of the shortest distance from the center position of the second bolt insertion hole to a lower end position of the first corner built-up portion, and a length of the shortest distance from the center position of the second bolt insertion hole to a lower end position of the side surface of the support base, are approximately same.

19. A column base structure comprising a column base fitting;

the column base fitting comprising;

a bottom plate formed as an approximately square shape, both surfaces of upper and lower, and thickness, and a support base inside from a peripheral portion of an upper surface of the bottom plate and extending upward in height, wherein a lower end portion of a column member is jointed on an upper surface of the support base, wherein, in the column base fitting, a first bolt insertion hole is formed at a position of each four corner portions of the square shape, wherein a second bolt insertion hole is formed at two positions closer to a center part of the bottom plate than the first bolt insertion hole in the direction of each four sides of the square shape, wherein a first corner built-up portion is located at a corner of the support base wherein the corner is the intersection of two sides of the support base and is formed to have such a shape as to protrude outward in the perpendicular direction from the side surface, in both ends in the direction of a side surface of the support base, but not protrude in a diagonal direction of the bottom plate from a corner portion of the support base, and wherein the first corner built-up portion fills the corner portion between the side surface and an upper surface of the bottom plate.

20. The column base structure according to claim 19, wherein a second corner built-up portion is formed at two positions closer to the center part than the first corner built-up portion in the direction of a side surface of the support base, wherein the second corner built-up portion fills the corner portion between the side surface and an upper surface of the bottom plate, and wherein the second built-up portion protrudes outward in the perpendicular direction from the side surface.

21. A column base fitting comprising, a bottom plate having both upper and lower surfaces, and thickness, and a support base on the center side from an outer contour of an upper surface of the bottom plate and extending upward in height, wherein a lower end portion of a column member is jointed on an upper surface of the support base, wherein a third bolt insertion hole is formed at a position of each corner portions of the outer contour, wherein a fourth bolt insertion hole is formed at two positions closer to a center part than the third bolt insertion hole in the direction of each sides of the outer contour, wherein a third corner built-up portion is formed so as to have a position extending toward center positions of the third bolt insertion hole and the fourth bolt insertion hole, in a part being the shortest distance from the center position of the third insertion hole of the support base, and wherein the third corner built-up portion fills the corner portion between a side surface of the support base and an upper surface of the bottom plate; and wherein the third corner built-up portion comprises a first protrusion portion inclining toward the upper surface of the bottom plate from a predetermined height position in a part being the shortest distance from the center position of the third bolt insertion hole of the support base and protruding toward the center position of the third bolt insertion hole, and a second protrusion portion inclining from the predetermined height position of the support base toward the upper surface of the bottom plate and being formed so as to extend toward the center position of the fourth bolt insertion hole in the corner portion between two parts on the fourth bolt insertion hole side of the first protrusion portion and the side surface of the support base.

22. The column base fitting according to claim 21, wherein, in the third corner built-up portion, a length of the shortest distance from the center position of the third bolt insertion hole to the third corner built-up portion, and a length of the shortest distance from the center position of the fourth bolt insertion hole to the side surface of the support base, are approximately same.

23. The column base fitting according to claim 22, wherein, in the third corner built-up portion, a length of the shortest distance from the center position of the third bolt insertion hole to the third corner built-up portion, and a length of the shortest distance from the center position of the fourth bolt insertion hole to the third corner built-up portion, are approximately same.

24. The column base fitting according to claim 23, wherein the center position of the third bolt insertion hole is located at a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

25. The column base fitting according to claim 23, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

26. The column base fitting according to claim 22, wherein the center position of the third bolt insertion hole is located at a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

27. The column base fitting according to claim 22, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

28. The column base fitting according to claim 21,
wherein, in the third corner built-up portion,
a length of the shortest distance from the center position of the third bolt insertion hole to the third corner built-up portion, and
a length of the shortest distance from the center position of the fourth bolt insertion hole to the side surface of the support base,
are approximately same.

29. The column base fitting according to claim 28,
wherein, in the third corner built-up portion,
a length of the shortest distance from the center position of the third bolt insertion hole to the third corner built-up portion, and
a length of the shortest distance from the center position of the fourth bolt insertion hole to the third corner built-up portion,
are approximately same.

30. The column base fitting according to claim 29,
wherein the center position of the third bolt insertion hole is located at a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

31. The column base fitting according to claim 29,
wherein the center position of the third bolt insertion hole is located at a position shifted closer to the center part of the support base than a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

32. The column base fitting according to claim 28,
wherein the center position of the third bolt insertion hole is located at a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

33. The column base fitting according to claim 28,
wherein the center position of the third bolt insertion hole is located at a position shifted closer to the center part of the support base than a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

34. The column base fitting according to claim 21,
wherein, in the third corner built-up portion,
a length of the shortest distance from the center position of the third bolt insertion hole to the third corner built-up portion, and
a length of the shortest distance from the center position of the fourth bolt insertion hole to the third corner built-up portion,
are approximately same.

35. The column base fitting according to claim 34,
wherein the center position of the third bolt insertion hole is located at a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

36. The column base fitting according to claim 34,
wherein the center position of the third bolt insertion hole is located at a position shifted closer to the center part of the support base than a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

37. The column base fitting according to claim 21,
wherein, in the third corner built-up portion,
a length of the shortest distance from the center position of the third bolt insertion hole to the third corner built-up portion, and
a length of the shortest distance from the center position of the fourth bolt insertion hole to the third corner built-up portion,
are approximately same.

38. The column base fitting according to claim 37,
wherein the center position of the third bolt insertion hole is located at a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

39. The column base fitting according to claim 37,
wherein the center position of the third bolt insertion hole is located at a position shifted closer to the center part of the support base than a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

40. The column base fitting according to claim 21,
wherein the center position of the third bolt insertion hole is located at a cross point position by two lines,
wherein one line passes two center positions of the fourth bolt insertion holes formed at two positions in the direction of one side of the bottom plate,
wherein another line passes two center positions of the fourth bolt insertion holes formed at two positions in the direction of another side adjacent in the perpendicular direction to the one side.

41. The column base fitting according to claim 21, wherein the center position of the third bolt insertion hole is located at a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

42. The column base fitting according to claim 21, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

43. The column base fitting according to claim 21, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

44. The column base fitting according to claim 21, wherein the third corner built-up portion is formed so that a length of the shortest distance from the center position of the fourth bolt insertion hole to the side surface of the support base, and a length of the shortest distance from the center position of the fourth bolt insertion hole to the third corner built-up portion, are approximately same.

45. The column base fitting according to claim 44, wherein the center position of the third bolt insertion hole is located at a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

46. The column base fitting according to claim 44, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

47. The column base fitting according to claim 21, wherein the third corner built-up portion is formed so that a length of the shortest distance from the center position of the fourth bolt insertion hole to the side surface of the support base, and a length of the shortest distance from the center position of the fourth bolt insertion hole to the third corner built-up portion, are approximately same.

48. The column base fitting according to claim 47, wherein the center position of the third bolt insertion hole is located at a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

49. The column base fitting according to claim 47, wherein the center position of the third bolt insertion hole is located at a position shifted closer to the center part of the support base than a cross point position by two lines, wherein one line passes two center positions of the fourth bolt insertion holes formed at two positions in the direction of one side of the bottom plate, wherein another line passes two center positions of the fourth bolt insertion holes formed at two positions in the direction of another side adjacent in the perpendicular direction to the one side.

50. A column base structure comprising a column base fitting;

wherein the column base fitting comprising;

a bottom plate having both upper and lower surfaces, and thickness, and a support base on the center side from an outer contour of an upper surface of the bottom plate and extending upward in height, wherein a lower end portion of a column member is jointed on an upper surface of the support body, wherein a third bolt insertion hole is formed at a position of each four corner portions of the outer contour, wherein a fourth bolt insertion hole is formed at two positions closer to a center part than the third bolt insertion hole in the direction of each four sides of the outer contour, wherein a third corner built-up portion is formed at a position so as to extend toward center positions of the third bolt insertion hole and the fourth bolt insertion hole, in a part being the shortest distance from a center position of the third insertion hole of the support base, and wherein the third corner built-up portion fills the corner portion between a side surface of the support base and the upper surface of the bottom plate; and wherein the third corner built-up portion comprises a first protrusion portion inclining toward the upper surface of the bottom plate from a predetermined height position in a part being the shortest distance from the center position of the third bolt insertion hole of the support base and protruding toward the center position of the third bolt insertion hole, and a second protrusion portion inclining from the predetermined height position of the support base toward the upper surface of the bottom plate and being formed so as to extend toward the center position of the fourth bolt insertion hole in the corner portion between two parts on the fourth bolt insertion hole side of the first protrusion portion and the side surface of the support base.

* * * * *